US009617993B2

(12) United States Patent
Mehta

(10) Patent No.: US 9,617,993 B2
(45) Date of Patent: Apr. 11, 2017

(54) MACERATOR PUMP APPARATUS WITH AN INTEGRAL WASTE VALVE ASSEMBLY AND A QUICK DISCONNECT DISCHARGE ASSEMBLY

(71) Applicant: Vinod K Mehta, Pittsgrove, NJ (US)

(72) Inventor: Vinod K Mehta, Pittsgrove, NJ (US)

(73) Assignee: RARITAN ENGINEERING COMPANY, INC., Millville, NJ (US)

( * ) Notice: Subject to any disclaimer, the term of this patent is extended or adjusted under 35 U.S.C. 154(b) by 743 days.

(21) Appl. No.: 14/169,158

(22) Filed: Jan. 31, 2014

(65) Prior Publication Data

US 2015/0219098 A1 Aug. 6, 2015

(51) Int. Cl.

| | |
|---|---|
| ***B02C 23/36*** | (2006.01) |
| ***F04C 13/00*** | (2006.01) |
| ***B02C 18/00*** | (2006.01) |
| ***F04C 5/00*** | (2006.01) |

(52) U.S. Cl.

CPC ..... *F04C 13/001* (2013.01); *B02C 18/0092* (2013.01); *B02C 23/36* (2013.01); *F04C 5/00* (2013.01); *Y10T 137/0318* (2015.04)

(58) Field of Classification Search

CPC ..... F04C 13/001; F04C 5/00; B02C 23/36; B02C 18/0092; Y10T 137/0318

See application file for complete search history.

(56) References Cited

U.S. PATENT DOCUMENTS

| | | | |
|---|---|---|---|
| 4,182,499 | A | 1/1980 | Kemper |
| 4,324,007 | A | 4/1982 | Morris |
| 5,987,658 | A | 11/1999 | Richards et al. |
| 6,991,192 | B2 | 1/2006 | Phillips et al. |
| 2008/0023090 | A1 | 1/2008 | Stegall |

*Primary Examiner* — Mark Rosenbaum

(74) *Attorney, Agent, or Firm* — Ash Tankha; Lipton, Weinberger & Husick

(57) ABSTRACT

A macerator pump apparatus (MPA) includes a waste valve assembly (WVA), a macerator assembly, a pumping assembly, and a quick disconnect discharge assembly (QDDA). An inlet port of the WVA receives waste matter from a waste holding tank (WHT). A valve member positioned within the WVA directs flow of the waste matter to the macerator assembly and isolates the waste matter within the WHT by closing the valve member before the MPA is disassembled for maintenance. The macerator assembly macerates the waste matter and transfers the macerated waste matter to the pumping assembly and to a discharge port of the QDDA. A quick disconnect member detachably connects an outlet plumbing pipe to the discharge port via a quick disconnect valve (QDV) for discharging the macerated waste matter. The QDV isolates the macerated waste matter within the outlet plumbing pipe by closing the QDV before the MPA is disassembled for maintenance.

24 Claims, 19 Drawing Sheets

MACERATOR PUMP APPARATUS WITH AN INTEGRAL WASTE VALVE ASSEMBLY AND A QUICK DISCONNECT DISCHARGE ASSEMBLY

BACKGROUND

A macerator pump is used for emptying sludge or sewage waste mixed with water, for example, from marine and recreational vehicle (RV) waste holding tanks. The macerator pump is also used for emptying fish box and livewell receptacles. The macerator pump is a self priming pump with a grinder chopper to grind solid waste to smaller particles. Typically, macerator pumps are directly connected to waste holding tanks along with inlet plumbing units, for example, hose or threaded couplings. A discharge section of the macerator pump is also connected directly to outlet plumbing units, for example, hose or threaded couplings. The macerator pump requires periodic maintenance, for example, for replacing seals and/or impellers. These maintenance tasks are tedious and can create a mess due to spillage of sewage waste, for example, while disconnecting hoses, threaded couplings, plumbing, etc. Moreover, installation of conventional valves in the discharge and inlet plumbing sections of the macerator pump requires a lot of space, and hence is not practical. The probability of spillage is very high in the case of a conventional valve connected at the inlet and outlet of the macerator pump. Therefore, there is a need for constructing a macerator pump to preclude spillage within the macerator pump and outside the macerator pump with respect to the inlet and outlet connections of the macerator pump.

Hence, there is a long felt but unresolved need for a macerator pump apparatus with a built-in waste valve member at an inlet port and a quick disconnect discharge assembly at a discharge port that isolates waste sewage from a waste holding tank and waste discharge respectively, and that allows routine maintenance without disconnecting plumbing units, for example, hose or threaded couplings, etc., from the macerator pump apparatus.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The macerator pump apparatus disclosed herein addresses the above mentioned needs for isolating waste sewage from a waste holding tank and waste discharge, and allowing routine maintenance without disconnecting plumbing units, for example, hose or threaded couplings etc., from the macerator pump apparatus. The macerator pump apparatus disclosed herein is used for isolating waste sewage and precluding spillage of the waste sewage within the macerator pump apparatus and outside the macerator pump apparatus in vehicles, for example, boats, recreational vehicles, caravans, buses, etc. The macerator pump apparatus disclosed herein comprises a waste valve assembly, a macerator assembly, a pumping assembly, and a quick disconnect discharge assembly. The waste valve assembly comprises an inlet port, a valve body, and a valve member. The inlet port is detachably connected to a waste holding tank. The inlet port receives waste matter from the waste holding tank. As used herein, the phrase "waste matter" refers to solid waste, liquid waste, or a combination of solid and liquid waste present in common waste, for example, sewage waste, sullage waste, etc.

In an embodiment, the inlet port of the waste valve assembly is configured as a threaded fit adaptor, a barb fit adaptor, or a slip fit adaptor to detachably connect to the waste holding tank in a threaded fit configuration, a barb fit configuration, or a slip fit configuration respectively. As used herein, the phrase "threaded fit" refers to a connection formed by connecting two parts, where an end of one part is threadably connected to an end of the other part via threaded sections defined on the ends. Also, as used herein, the phrase "barb fit" refers to a connection formed by connecting two parts, where an end of one part is axially pushed on to a protruding section defined on an end of the other part. Also, as used herein, the phrase "slip fit" refers to a connection formed by connecting two parts, where an end of one part is slipped over or glued to an end of the other part.

The valve body of the waste valve assembly defines a valve cavity. The valve cavity is in fluid communication with the inlet port. The valve member is positioned within the valve cavity of the valve body. The valve member directs flow of the waste matter from the valve cavity to a macerator cavity of the macerator assembly in fluid communication with the valve cavity via a macerator adaptor. The valve member further isolates the waste matter within the waste holding tank by closing the valve member before the macerator pump apparatus is disassembled for a maintenance operation. In an embodiment, the valve member of the waste valve assembly is a sliding gate valve.

In an embodiment, the waste valve assembly further comprises a quarter turn knob operably connected to the valve member and the valve body of the waste valve assembly. The quarter turn knob induces an angular movement in the valve member to open and close the valve member within a one quarter turn range of the quarter turn knob. In an embodiment, the waste valve assembly further comprises an open and close indicator operably connected to the quarter turn knob. The open and close indicator, in communication with the quarter turn knob, indicates an open position and a closed position of the valve member. In an embodiment, the waste valve assembly is made of an inert or non-corrosive material. In an embodiment, the waste valve assembly is removably fastened directly to a combination of the macerator assembly, the pumping assembly, and the quick disconnect discharge assembly with minimal space requirements. The waste valve assembly can be operated using a standard tool member, for example, a socket wrench by a quarter turn of the standard tool member. The waste valve assembly can also be operated manually by hand. The waste valve assembly fits in a limited space. In an embodiment, the waste valve assembly further comprises replaceable valve seal components, for example, valve sealing elements, a valve shaft O-ring, a valve housing O-ring, etc.

The macerator assembly is removably fastened to the waste valve assembly. The macerator assembly comprises a macerator housing defining the macerator cavity. The macerator cavity receives the waste matter from the valve cavity of the waste valve assembly. The macerator assembly macerates the waste matter in the macerator cavity and transfers the macerated waste matter to a pump cavity of the pumping assembly in fluid communication with the macerator cavity. In an embodiment, the macerator assembly further comprises a macerator blade positioned within the macerator cavity of the macerator assembly. The macerator blade is rotated by an electric motor via a shaft of the electric motor.

The shaft of the electric motor is fixedly connected to a hub of the macerator blade. The macerator blade macerates the waste matter and directs the macerated waste matter to the pump cavity in fluid communication with the macerator cavity. In an embodiment, the waste valve assembly further comprises a first valve sealing element and a second valve sealing element. The first valve sealing element is sandwiched between the inlet port and the valve member of the waste valve assembly. The second valve sealing element is sandwiched between the valve member of the waste valve assembly and the macerator housing of the macerator assembly. The first valve sealing element and the second valve sealing element block leakage of the waste matter at points of contact between the inlet port, the valve member, and the macerator cavity.

The pumping assembly is fixedly connected to the macerator assembly. The pumping assembly comprises a pump housing defining the pump cavity. The pump cavity receives the macerated waste matter from the macerator cavity of the macerator assembly. The pumping assembly pumps the macerated waste matter to a discharge port of the quick disconnect discharge assembly in fluid communication with the pump cavity. In an embodiment, the pumping assembly further comprises an impeller positioned within the pump cavity of the pumping assembly. The impeller is connected to and rotated by the electric motor via the shaft of the electric motor. The shaft of the electric motor is fixedly connected to the impeller. The impeller pumps the macerated waste matter to the discharge port of the quick disconnect discharge assembly in fluid communication with the pump cavity. In an embodiment, the impeller of the pumping assembly is made of an elastomeric material.

The quick disconnect discharge assembly is operably connected to the pumping assembly. The quick disconnect discharge assembly comprises the discharge port, a quick disconnect member, and a quick disconnect valve. The discharge port extends from the pump housing of the pumping assembly. The discharge port receives the macerated waste matter from the pump cavity of the pumping assembly. The quick disconnect member is operably connected to the discharge port. The quick disconnect member detachably connects an outlet plumbing pipe to the discharge port via the quick disconnect valve for discharging the macerated waste matter. In an embodiment, the quick disconnect member is configured as a threaded fit adaptor, a barb fit adaptor, or a slip fit adaptor to detachably connect to the quick disconnect valve or the outlet plumbing pipe in a threaded fit configuration, a barb fit configuration, or a slip fit configuration respectively. The quick disconnect valve detachably connects the quick disconnect member to the outlet plumbing pipe. The quick disconnect valve opens and closes the outlet plumbing pipe to direct flow of the macerated waste matter through the outlet plumbing pipe. The quick disconnect valve further isolates the macerated waste matter within the outlet plumbing pipe by closing the quick disconnect valve before the macerator pump apparatus is disassembled for a maintenance operation.

In an embodiment, the quick disconnect discharge assembly further comprises a discharge seal member positioned between the quick disconnect member and the discharge port of the quick disconnect discharge assembly. The discharge seal member provides a seal between the quick disconnect member and the discharge port to prevent leakage of the macerated waste matter. In an embodiment, the discharge seal member is an O-ring type seal. In an embodiment, the macerator pump apparatus disclosed herein further comprises a clip member operably inserted between the discharge port and the quick disconnect member. The clip member detachably connects the quick disconnect member to the discharge port.

Disclosed herein is also a method for macerating and discharging waste matter. Waste matter from the waste holding tank is received into the valve cavity of the valve body of the waste valve assembly via the inlet port detachably connected to the waste holding tank. The valve member positioned within the valve cavity of the valve body directs flow of the received waste matter from the valve cavity to the macerator cavity of the macerator assembly. The macerator blade positioned within the macerator cavity of the macerator assembly macerates the received waste matter in the macerator cavity. A suction force generated by the impeller positioned within the pump cavity of the pumping assembly suctions the macerated waste matter to the pump cavity in fluid communication with the macerator cavity. The impeller pumps the macerated waste matter from the pump cavity to the discharge port of the quick disconnect discharge assembly in fluid communication with the pump cavity. The quick disconnect member of the quick disconnect discharge assembly directs the macerated waste matter from the discharge port to the outlet plumbing pipe by the opening and closing the quick disconnect valve of the quick disconnect discharge assembly.

Disclosed herein is also a method for isolating waste matter within the waste holding tank and isolating the macerated waste matter within the outlet plumbing pipe during a maintenance operation of the macerator pump apparatus. The closing of the valve member of the waste valve assembly isolates the waste matter within the waste holding tank before the macerator pump apparatus is disassembled for a maintenance operation. The closing of the quick disconnect valve of the quick disconnect discharge assembly isolates the macerated waste matter within the outlet plumbing pipe before the macerator pump apparatus is disassembled for a maintenance operation.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a structure or a method step referenced by a numeral in a drawing carries over to the description of that structure or method step shown by that same numeral in any subsequent drawing herein.

DETAILED DESCRIPTION OF THE INVENTION

Figure 1A:
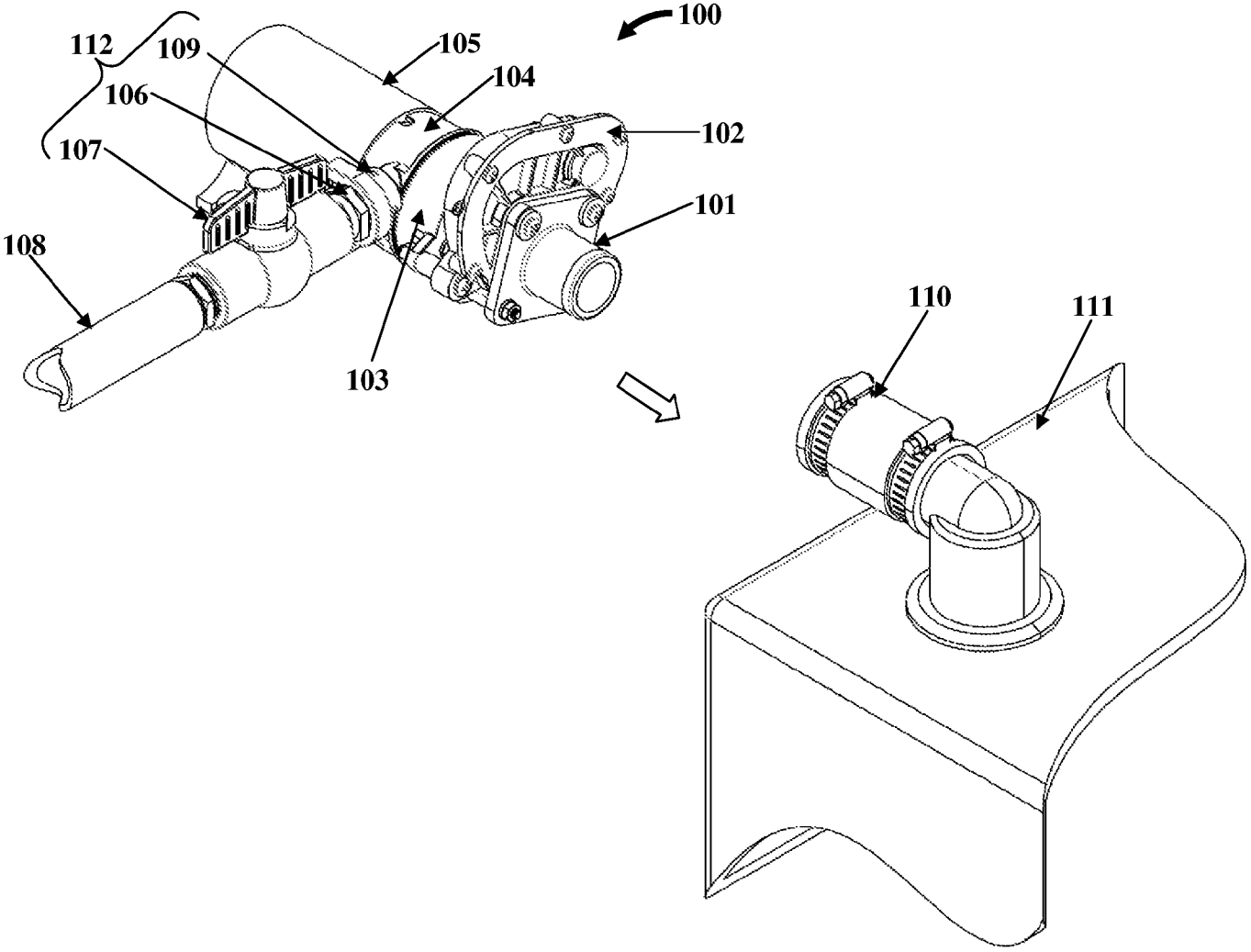
FIG. 1A exemplarily illustrates a front perspective view of a macerator pump apparatus, showing the macerator pump apparatus configured to be connected to a tank outlet pipe of a waste holding tank.
Figure 1B:
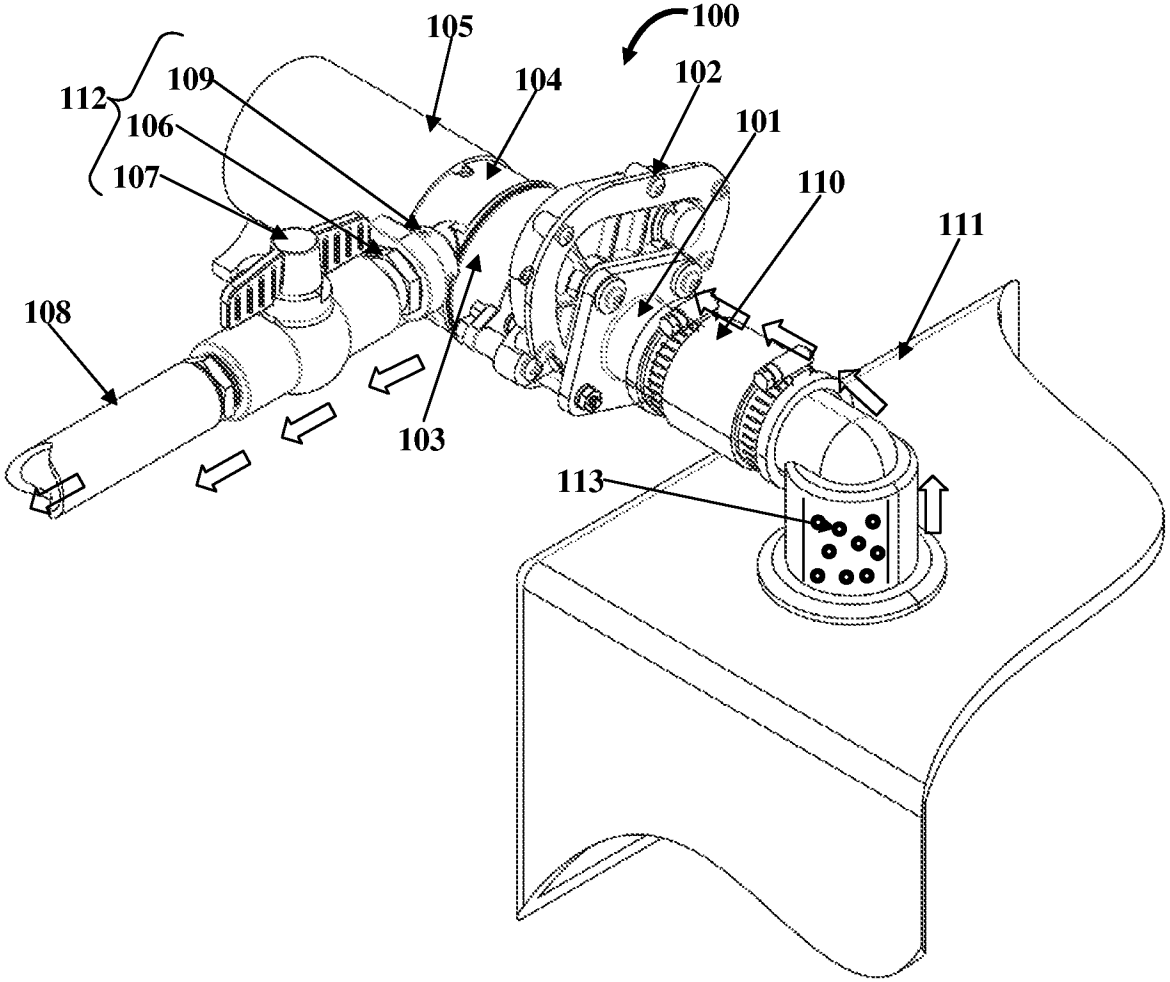
FIG. 1B exemplarily illustrates a front perspective view of the macerator pump apparatus, showing the macerator pump apparatus connected to the tank outlet pipe of the waste holding tank.

FIGS. 1A-1B exemplarily illustrate front perspective views of a macerator pump apparatus 100. FIG. 1A shows the macerator pump apparatus 100 configured to be connected to a tank outlet pipe 110 of a waste holding tank 111. The macerator pump apparatus 100 disclosed herein comprises an inlet port 101, a valve body 102, a macerator housing 103, a pump housing 104, and a quick disconnect discharge assembly 112. FIG. 1B shows the macerator pump apparatus 100 connected to the tank outlet pipe 110 of the waste holding tank 111. The inlet port 101 of the macerator pump apparatus 100 is removably connected to the tank outlet pipe 110 of the waste holding tank 111 to receive waste matter 113 contained in the waste holding tank 111 as exemplarily illustrated in FIG. 1B. As used herein, the phrase "waste matter" refers to solid waste, liquid waste, or a combination of solid and liquid waste present in common waste, for example, sewage waste, sullage waste, etc. A valve body 102 is removably fastened to the inlet port 101. A valve member 117, exemplarily illustrated in FIG. 2, positioned inside the valve body 102 directs flow of the waste matter 113 to a macerator cavity 119 defined by the macerator housing 103 exemplarily illustrated in FIG. 2. The macerator housing 103 is removably fastened to the valve body 102. The waste matter 113 is macerated inside the macerator cavity 119.

Figure 2:
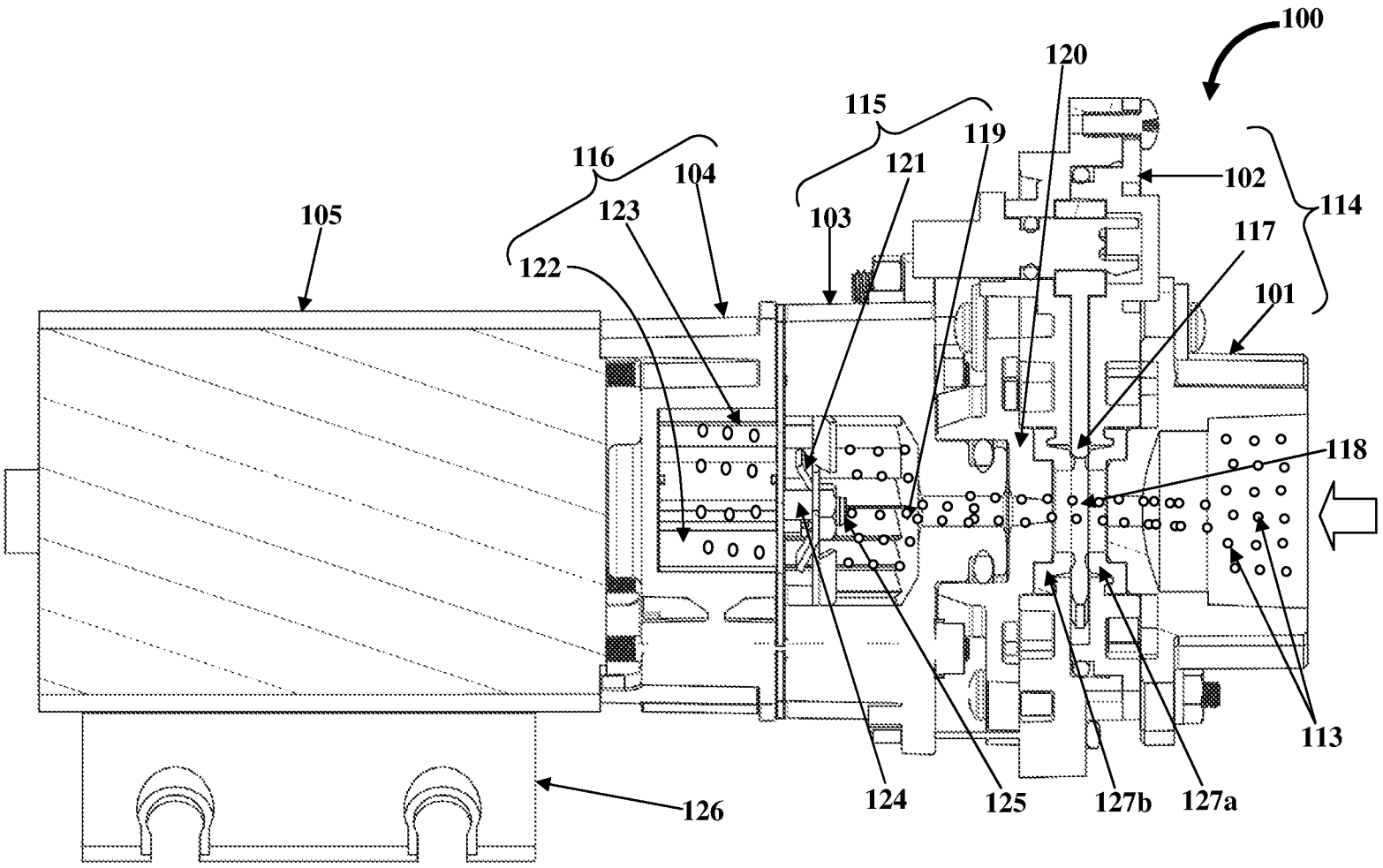
FIG. 2 exemplarily illustrates a sectional view of the macerator pump apparatus.

The macerated waste matter 113 is transferred from the macerator cavity 119 of the macerator housing 103 to a pump cavity 122 in fluid communication with the macerator cavity 119 exemplarily illustrated in FIG. 2. The pump cavity 122 is defined by the pump housing 104. The pump housing 104 is removably fastened to the macerator housing 103. The macerated waste matter 113 is pumped from the pump cavity 122 to a discharge port 109 in fluid communication with the pump cavity 122. The discharge port 109 discharges the macerated waste matter 113 to an outlet plumbing pipe 108 via a quick disconnect member 106 and a quick disconnect valve 107. The discharge port 109, the quick disconnect member 106, the quick disconnect valve 107, and the outlet plumbing pipe 108 are removably connected to each other by quick disconnect fittings and are in fluid communication with each other. The quick disconnect member 106, the discharge port 109, and the quick disconnect valve 107 constitute the quick disconnect discharge assembly 112. An electric motor 105 is removably connected to the pump housing 104, and axially aligned with the pump housing 104 and the macerator housing 103. The electric motor 105 drives the macerator pump apparatus 100 as disclosed in the detailed description of FIG. 2.

FIG. 2 exemplarily illustrates a sectional view of the macerator pump apparatus 100. The macerator pump apparatus 100 disclosed herein comprises a waste valve assembly 114, a macerator assembly 115, a pumping assembly 116, and the quick disconnect discharge assembly 112 exemplarily illustrated in FIGS. 1A-1B. The waste valve assembly 114 disclosed herein comprises the inlet port 101, the valve body 102, and the valve member 117. The inlet port 101 is detachably connected to a waste holding tank 111 and receives waste matter 113 from the waste holding tank 111 as exemplarily illustrated in FIGS. 1A-1B.

As exemplarily illustrated in FIG. 2, the valve body 102 of the waste valve assembly 114 defines a valve cavity 118. The valve cavity 118 is in fluid communication with the inlet port 101. The valve member 117 is positioned within the valve cavity 118 of the valve body 102. The valve member 117 directs flow of the waste matter 113 from the valve cavity 118 to the macerator cavity 119 of the macerator assembly 115 which is in fluid communication with the valve cavity 118 via a macerator adaptor 120. The valve member 117 further isolates the waste matter 113 within the waste holding tank 111 by closing the valve member 117 before the macerator pump apparatus 100 is disassembled for a maintenance operation. In some cases, the level of the waste matter 113 in the waste holding tank 111 is higher than the level of the macerator pump apparatus 100. In such cases, when a user disassembles the macerator pump apparatus 100 for a maintenance operation, waste matter 113 spills through the point of contact between the tank outlet pipe 110 and the inlet port 101 exemplarily illustrated in FIGS. 1A-1B due to gravity. The closing of the valve member 117 prevents the spillage of the waste matter 113 or the sewage through the point of contact between the tank outlet pipe 110 and the inlet port 101.

In an embodiment, the valve member 117 of the waste valve assembly 114 is, for example, a sliding gate valve. In an embodiment, the waste valve assembly 114 is made of an inert material, for example, polyvinyl chloride (PVC). The inert material is used due to the corrosive environment of the waste matter 113, for example, sewage waste. In an embodiment, the waste valve assembly 114 is removably fastened directly to a combination of the macerator assembly 115, the pumping assembly 116, and the quick disconnect discharge assembly 112 with minimal space requirements. The waste valve assembly 114 can be operated, for example, using a standard tool member such as a socket wrench by a quarter turn of the standard tool member or manually by hand. The waste valve assembly 114 fits in a limited space. The waste valve assembly 114 facilitates maintenance and repair of the macerator pump apparatus 100 without disconnecting plumbing units, for example, the tank outlet pipe 110 exemplarily illustrated in FIGS. 1A-1B.

As exemplarily illustrated in FIG. 2, the macerator assembly 115 of the macerator pump apparatus 100 is removably fastened to the waste valve assembly 114. The macerator assembly 115 comprises the macerator housing 103 that defines the macerator cavity 119. The macerator cavity 119 receives the waste matter 113 from the valve cavity 118 of the waste valve assembly 114. The macerator assembly 115 macerates the waste matter 113 in the macerator cavity 119 and transfers the macerated waste matter 113 to the pump cavity 122 of the pumping assembly 116 which is in fluid communication with the macerator cavity 119. In an embodiment, the macerator assembly 115 further comprises a macerator blade 121 positioned within the macerator cavity 119 of the macerator assembly 115. The macerator blade 121 is rotated by a shaft 124 which is rotated by the electric motor 105. The shaft 124 rotated by the electric motor 105 is fixedly connected to a hub 125 of the macerator blade 121. The electric motor 105 rests on a motor base 126. Rotation of the electric motor 105 causes the shaft 124 that is connected to the hub 125 of the macerator blade 121 to rotate, thereby causing the macerator blade 121 to rotate. The macerator blade 121 macerates the waste matter 113 and directs the macerated waste matter 113 to the pump cavity 122 of the pumping assembly 116 which is in fluid communication with the macerator cavity 119. The macerator blade 121 macerates the waste matter 113 to reduce the particle size of the waste matter 113.

As exemplarily illustrated in FIG. 2, the pumping assembly 116 of the macerator pump apparatus 100 is fixedly connected to the macerator assembly 115. The pumping assembly 116 comprises a pump housing 104 that defines the pump cavity 122. The pump cavity 122 receives the macerated waste matter 113 from the macerator cavity 119 of the macerator assembly 115. The pumping assembly 116 pumps the macerated waste matter 113 to the discharge port 109 of the quick disconnect discharge assembly 112 exemplarily illustrated in FIGS. 1A-1B, which is in fluid communication with the pump cavity 122. In an embodiment, the pumping assembly 116 further comprises an impeller 123 positioned within the pump cavity 122 of the pumping assembly 116. The impeller 123 is connected to and rotated by the shaft 124 which is rotated by the electric motor 105. The shaft 124 rotated by the electric motor 105 is fixedly connected to the impeller 123. The impeller 123 pumps the macerated waste matter 113 to the discharge port 109 of the quick disconnect discharge assembly 112 which is in fluid communication with the pump cavity 122 as disclosed in the detailed description of FIGS. 3A-3B. In an embodiment, the impeller 123 of the pumping assembly 116 is made of an elastomeric material, for example, nitrile rubber.

In an embodiment as exemplarily illustrated in FIG. 2, the waste valve assembly 114 further comprises a first valve sealing element **127*a* and a second valve sealing element 127*b*. The first valve sealing element 127*a* is sandwiched between the inlet port 101 and the valve member 117 of the waste valve assembly 114. The second valve sealing element 127*b* is sandwiched between the valve member 117 of the waste valve assembly 114 and the macerator housing 103 of the macerator assembly 115. The first valve sealing element 127*a* and the second valve sealing element 127*b* block leakage of the waste matter 113 at points of contact between the inlet port 101, the valve member 117, and the macerator cavity 119**.

Figure 3A:
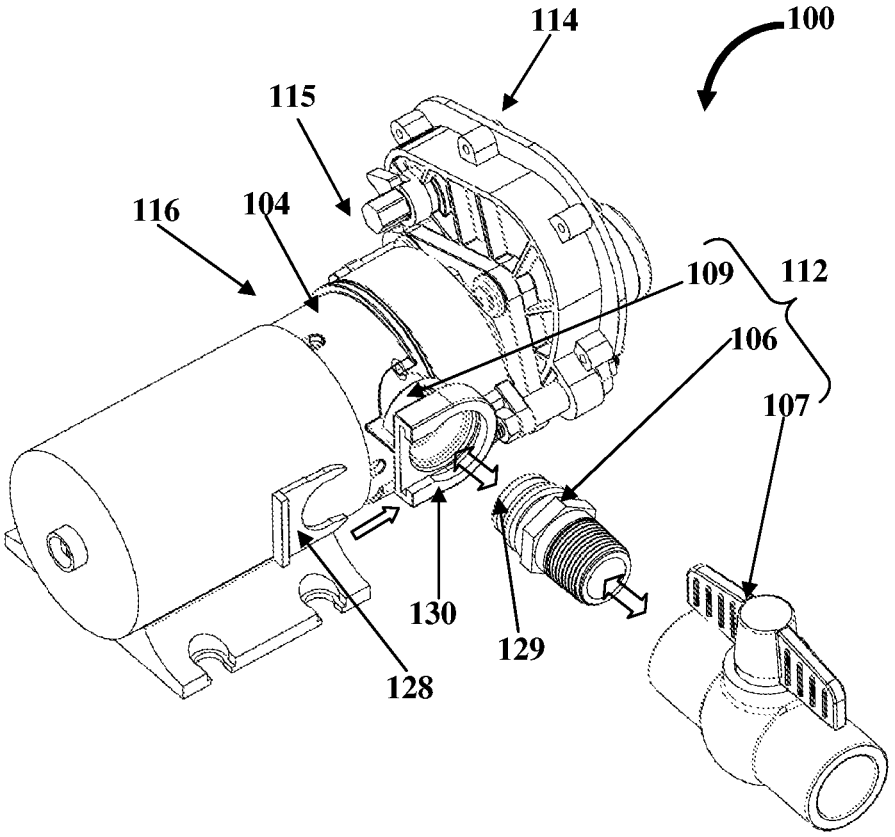
FIG. 3A exemplarily illustrates a rear perspective view of the macerator pump apparatus, showing a partial exploded view of a quick disconnect discharge assembly.
Figure 3B:
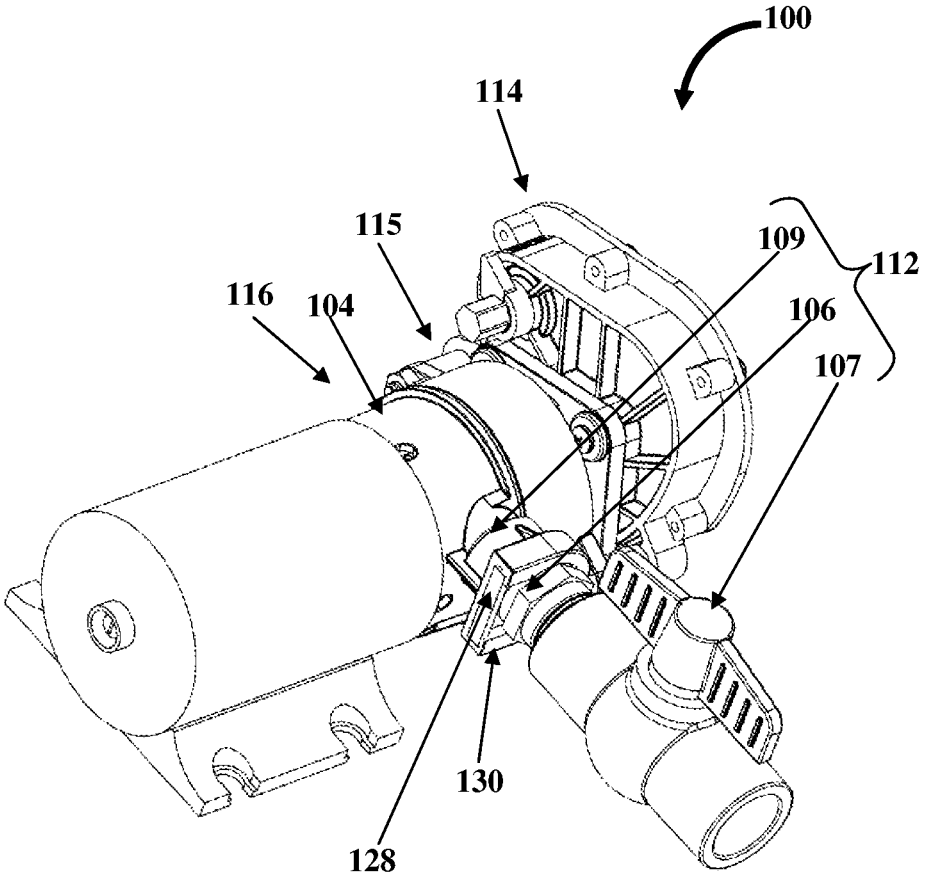
FIG. 3B exemplarily illustrates a rear perspective view of the macerator pump apparatus with the assembled quick disconnect discharge assembly.

FIGS. 3A-3B exemplarily illustrate rear perspective views of the macerator pump apparatus 100. FIG. 3A shows a partial exploded view of the quick disconnect discharge assembly 112 of the macerator pump apparatus 100. FIG. 3B shows the macerator pump apparatus 100 with the assembled quick disconnect discharge assembly 112. The quick disconnect discharge assembly 112 is operably connected to the pumping assembly 116. The quick disconnect discharge assembly 112 comprises the discharge port 109, the quick disconnect member 106, and the quick disconnect valve 107. The discharge port 109 extends from the pump housing 104 of the pumping assembly 116. The discharge port 109 is in fluid communication with the pump cavity 122 of the pump housing 104 exemplarily illustrated in FIG. 2. The discharge port 109 receives the macerated waste matter 113 exemplarily illustrated in FIG. 2, from the pump cavity 122 of the pump housing 104. The quick disconnect member 106 is operably connected to the discharge port 109. The quick disconnect member 106 detachably connects an outlet plumbing pipe 108 exemplarily illustrated in FIGS. 1A-1B, to the discharge port 109 via the quick disconnect valve 107 for discharging the macerated waste matter 113. The quick disconnect valve 107 detachably connects the quick disconnect member 106 to the outlet plumbing pipe 108. The quick disconnect valve 107 opens and closes the outlet plumbing pipe 108 to direct flow of the macerated waste matter 113 through the outlet plumbing pipe 108. The quick disconnect valve 107 further isolates the macerated waste matter 113 within the outlet plumbing pipe 108 by closing the quick disconnect valve 107 before the macerator pump apparatus 100 is disassembled or disconnected from the outlet plumbing pipe 108 for a maintenance operation, thereby preventing spillage from the outlet plumbing pipe 108. Due to the configuration of the macerator pump apparatus 100, the hose or plumbing, for example, the outlet plumbing pipe 108 does not have to be disconnected to remove the macerator pump apparatus 100 from the plumbing for routine maintenance. In most cases, the hose or plumbing is positioned higher than the level of the macerator pump apparatus 100 resulting in a backward flow and spillage of the waste matter 113 due to gravity when the outlet plumbing pipe 108 is disconnected from the discharge port 109 for a maintenance operation. Before disconnecting the outlet plumbing pipe 108 from the discharge port 109, the quick disconnect valve 107 of the quick disconnect discharge assembly 112 is closed. The closing of the quick disconnect valve 107 isolates the macerated waste matter 113 within the outlet plumbing pipe 108 and prevents the backward flow and spillage of the macerated waste matter 113 when the outlet plumbing pipe 108 is disconnected from the discharge port 109 for a maintenance operation. Since there no spillage of sewage or the waste matter 113, the maintenance task is cleaner and less messy.

In an embodiment as exemplarily illustrated in FIGS. 3A-3B, the macerator pump apparatus 100 disclosed herein further comprises a clip member 128 operably inserted between the discharge port 109 and the quick disconnect member 106 of the quick disconnect discharge assembly 112. The clip member 128 detachably connects the quick disconnect member 106 to the discharge port 109. The clip member 128 is inserted into a clip sleeve 130 fixedly connected to the discharge port 109. The quick disconnect member 106 is removably connected to the discharge port 109, thereby forming a quick disconnect connection between the quick disconnect member 106 and the discharge port 109 via the arrangement of the clip member 128 and the clip sleeve 130. To remove the quick disconnect member 106, the clip member 128 is slid out or removed from the clip sleeve 130. To install the quick disconnect member 106, the clip member 128 is inserted into the clip sleeve 130.

In an embodiment as exemplarily illustrated in FIG. 3A, the quick disconnect discharge assembly 112 further comprises a discharge seal member 129 positioned between the quick disconnect member 106 and the discharge port 109 of the quick disconnect discharge assembly 112. The discharge seal member 129 provides a seal between the quick disconnect member 106 and the discharge port 109 to prevent leakage of the macerated waste matter 113. In an embodiment, the discharge seal member 129 is, for example, an O-ring type seal.

Figure 4:
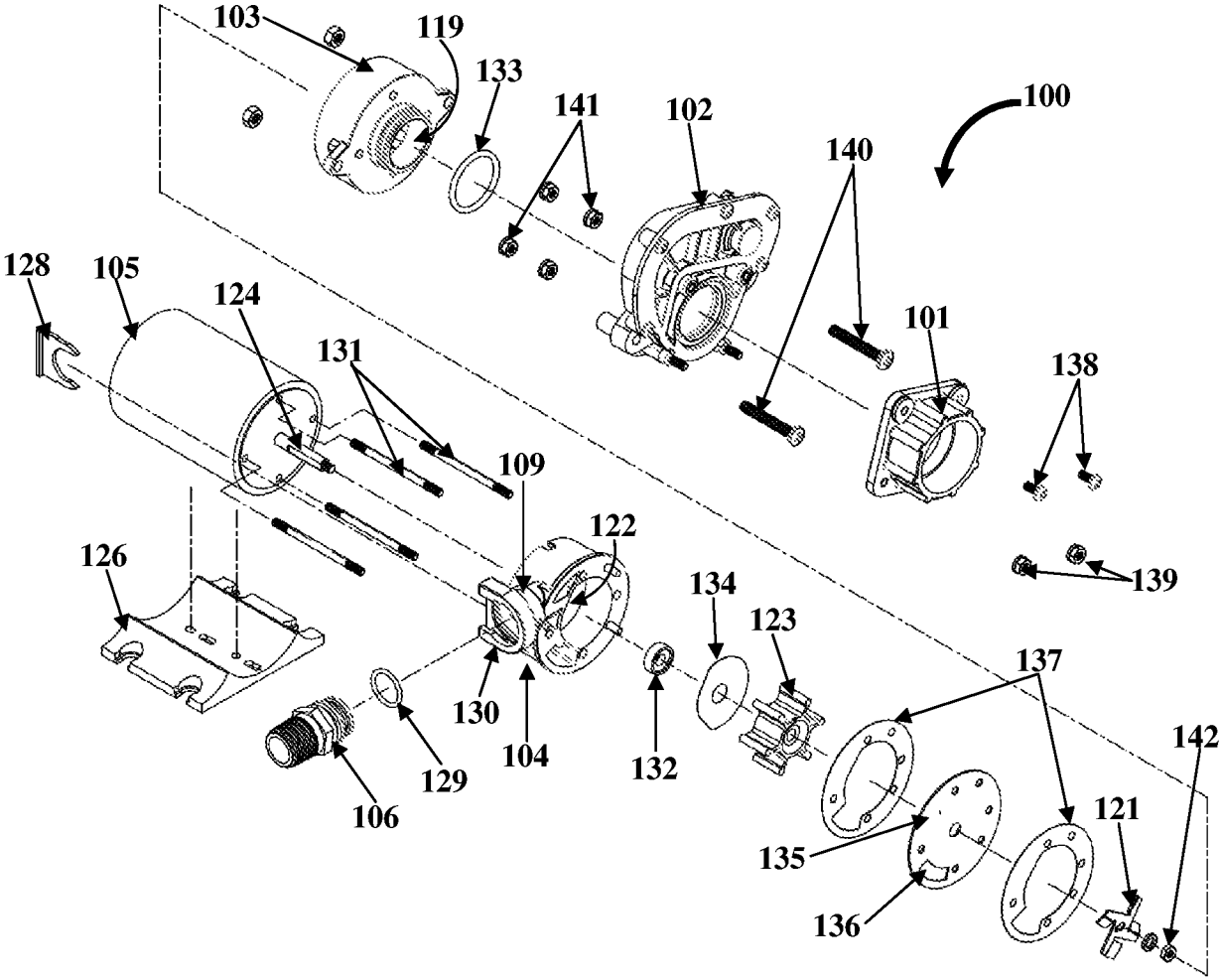
FIG. 4 exemplarily illustrates an exploded view of the macerator pump apparatus.

FIG. 4 exemplarily illustrates an exploded view of the macerator pump apparatus 100. The electric motor 105 of the macerator pump apparatus 100 is fixedly positioned and aligned with the pump housing 104. The electric motor 105 rotates the macerator blade 121 which reduces the particle size of solids present in the waste matter 113 exemplarily illustrated in FIG. 2. The electric motor 105 further rotates the impeller 123 for pumping the macerated waste matter 113 from the pump cavity 122 to the discharge port 109. The motor base 126 supports the electric motor 105 and the macerator pump apparatus 100. The motor base 126 secures the macerator pump apparatus 100 to a mounting surface, for example, a concrete base. The shaft 124 rotated by the electric motor 105 extends axially from the electric motor 105 to connect to the impeller 123 and the macerator blade 121. The shaft 124 is fastened to the impeller 123 and the macerator blade 121 via a locking nut 142. Pump mounting studs 131 mount the pump housing 104 onto the electric motor 105 and assist in fastening the electric motor 105 to the pump housing 104. A shaft seal 132 seals the shaft 124 of the electric motor 105, where the shaft 124 enters the pump housing 104.

Figure 7A:
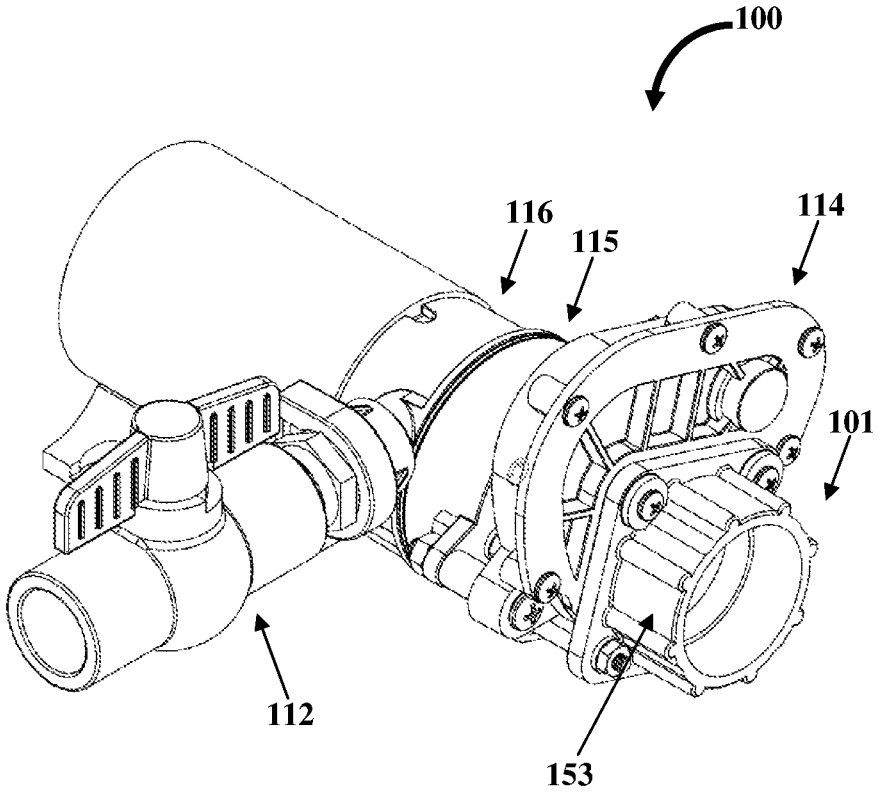
FIG. 7A exemplarily illustrates a front perspective view of the macerator pump apparatus, showing an inlet port of the waste valve assembly configured as a threaded fit adaptor.

As exemplarily illustrated in FIG. 4, the inlet port 101 is, for example, a 1.5" national pipe thread (NPTz) adaptor 153 as exemplarily illustrated in FIG. 7A, for threadably connecting a pipe, for example, the tank outlet pipe 110 exemplarily illustrated in FIGS. 1A-1B, to the inlet port 101. In an embodiment, the inlet port 101 can also be, for example, a barb fit adaptor 154 to connect a flexible hose (not shown) directly to the inlet port 101, or a slip fit adaptor 155 facilitating ridged plastic piping to be glued on to the inlet port 101 as exemplarily illustrated in FIGS. 7B-7C. The valve body 102 is, for example, a 1.5" rotary knife gate valve assembly. The valve body 102 functions to retain the waste matter 113 in the macerator pump apparatus 100 by closing of the valve member 117, which retains the waste matter 113 in the waste holding tank 111 and the inlet port 101 exemplarily illustrated in FIGS. 1A-1B and FIG. 2. Closing the valve member 117 also facilitates maintenance of the macerator pump apparatus 100 by retaining the waste matter 113 in the macerator pump apparatus 100 as the macerator pump apparatus 100 is easily removed from the tank outlet pipe 110 by disconnecting the inlet port 101 from the valve body 102 at the connection of the macerator housing 103 and the valve member 117. The inlet port 101 is removably connected to the valve body 102 via a first set of bolts 138 and a first set of nuts 139. The valve body 102 is removably connected to the macerator housing 103 via a second set of bolts 140 and a second set of nuts 141.

As exemplarily illustrated in FIG. 4, the macerator housing 103 is configured, for example, as a teeth housing, used to macerate the waste matter 113. The macerator housing 103 defines the macerator cavity 119 to house the macerator blade 121. The macerator blade 121 reduces the size of solid particles in the waste matter 113 before that waste matter 113 enters the pump cavity 122 of the pump housing 104, thereby reducing clogging inside the pump cavity 122, while also facilitating processing of the waste matter 113. The macerator housing 103 further comprises, for example, stationary teeth to assist in the maceration process. The macerator housing 103 can be quickly disconnected from the valve body 102, when maintenance is required, while maintaining any piping within the plumbing system intact. One or more pump adaptor O-rings 133 are operably positioned between the macerator housing 103 and the valve body 102 to provide a seal thereof.

The pump housing 104 houses the impeller 123. The pump cavity 122 creates a suction pressure when the impeller 123 is rotated within the pump cavity 122 to draw the macerated waste matter 113 from the macerator cavity 119 to be discharged to the discharge port 109. A wear plate 134 protects the pump housing 104 from wear as the impeller 123 rotates. The quick disconnect member 106, a pump cover 135, and the macerator housing 103 are removably connected directly to the pump housing 104. The impeller 123 is positioned within the pump cavity 122 of the pump housing 104. When the impeller 123 is rotated by the electric motor 105, the impeller 123 creates a suction force for drawing the waste matter 113 into the pump cavity 122 from the macerator cavity 119, and also for pumping the waste matter 113 out of the pump cavity 122 via the discharge port 109 and the quick disconnect member 106 which are in fluid communication with the pump cavity 122. The pump cover 135 creates a barrier between the pump housing 104 and the macerator housing 103. The pump cover 135 also comprises an opening 136 that draws the waste matter 113 into the pump cavity 122 from the suction caused by the impeller 123. Gaskets 137 provide a seal between the pump housing 104 and the pump cover 135, and between the pump cover 135 and the macerator housing 103.

As exemplarily illustrated in FIG. 4, the quick disconnect member 106 is configured, for example, as a quick disconnect adaptor or a discharge adaptor nipple. The quick disconnect member 106 connects to the discharge port 109, where the outlet plumbing pipe 108 exemplarily illustrated in FIGS. 1A-1B, is connected. The outlet plumbing pipe 108 is any plumbing pipe made of, for example, steel, polyvinyl chloride (PVC), etc. The quick disconnect member 106 can be easily disconnected from the pumping assembly 116 exemplarily illustrated in FIG. 2 and FIGS. 3A-3B, by releasing the clip member 128, when maintenance is required, leaving any piping within the plumbing system intact. The clip member 128 is, for example, a discharge adaptor retaining clip. The clip member 128 is inserted into or removed from a clip sleeve 130 to easily and quickly connect and disconnect the quick disconnect member 106 from the discharge port 109 that extends from the pump housing 104. The discharge seal member 129 is, for example, an O-ring or a discharge adaptor nipple. The discharge seal member 129 creates a seal between the quick disconnect member 106 and the discharge port 109 that extends from the pump housing 104.

Figure 5:
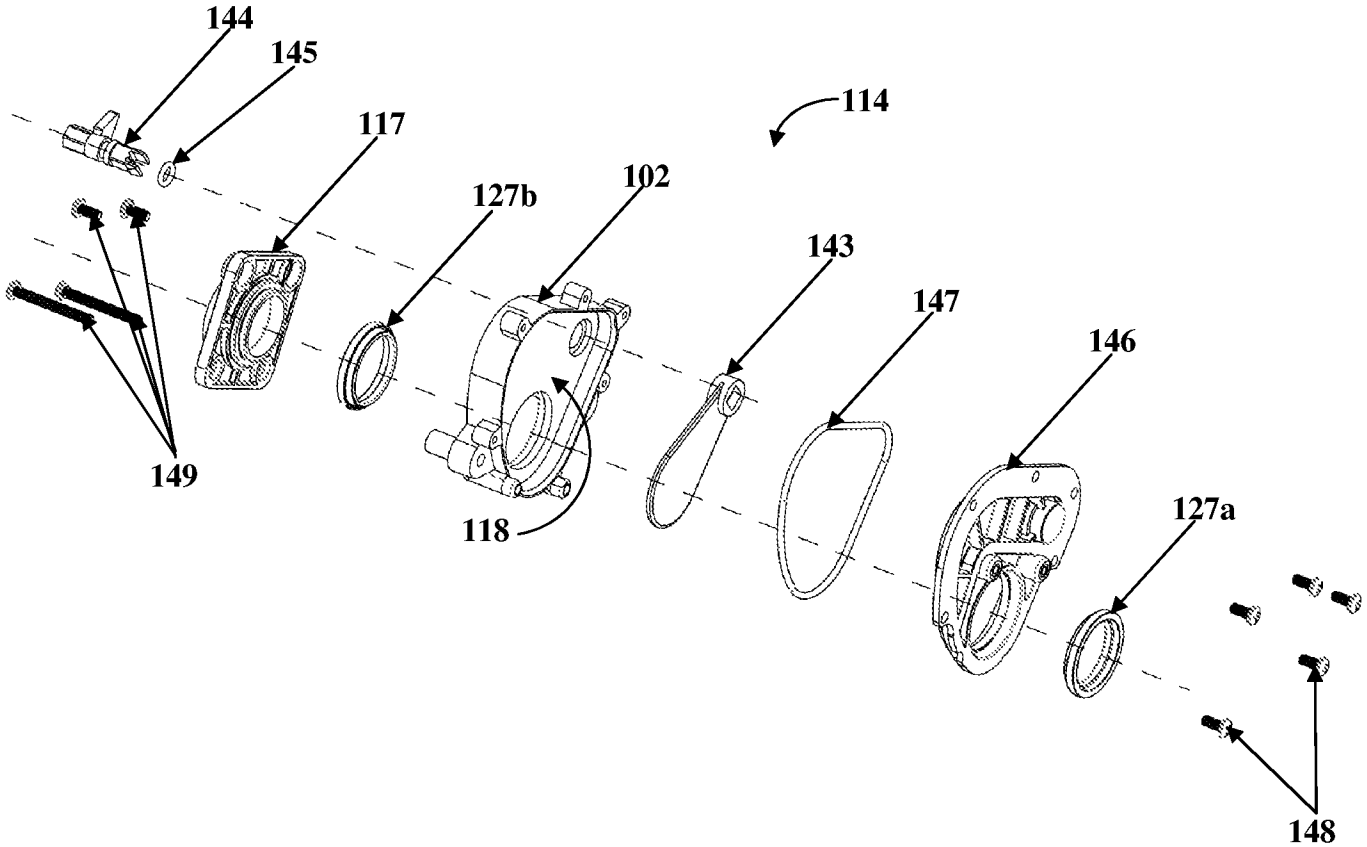
FIG. 5 exemplarily illustrates a partial exploded view of a waste valve assembly of the macerator pump apparatus.

FIG. 5 exemplarily illustrates a partial exploded view of the waste valve assembly 114. The valve cavity 118 of the valve body 102 receives waste matter 113 from the inlet port 101 fastened to the valve body 102 as exemplarily illustrated in FIG. 2. The valve body 102 is, for example, a rotary knife gate valve housing, configured to house the valve member 117 and a valve gate 143. The valve member 117, for example, a built in pump adaptor or a rotary knife gate valve, is positioned within the valve cavity 118 in fluid communication with the macerator cavity 119 of the macerator assembly 115 via the macerator adaptor 120 as exemplarily illustrated in FIG. 2. The valve member 117, in communication with the valve gate 143, opens and closes to direct the flow of waste matter 113 from the inlet port 101 to the macerator cavity 119 of the macerator assembly 115. The valve gate 143 is, for example, a rotary knife gate valve gate, and creates a barrier to the flow of waste matter 113, when closed by a rotation of a quarter turn knob 144. The valve gate 143 is opened and closed by the rotation of the quarter turn knob 144 to direct the passage of the waste matter 113. The quarter turn knob 144 is, for example, a rotary knife gate valve gate shaft or a quarter turn drive shaft. The quarter turn knob 144 is provided to open and close the valve member 117 by actuating the valve gate 143. A valve shaft O-ring 145 is, for example, a rotary knife gate valve shaft O-ring, creates a seal at the entry of the quarter turn knob 144 into the valve body 102.

As exemplarily illustrated in FIG. 5, a valve cover 146, for example, a rotary knife gate valve cover, is used to cover the valve body 102. A valve housing O-ring 147, for example, a rotary knife gate valve housing O-ring, provides a seal between the valve body 102 and the valve cover 146. The valve sealing elements 127*a* and 127*b* comprising the first valve sealing element 127*a* and the second valve sealing element 127*b* are, for example, rotary knife gate valve adaptor seals. The first valve sealing element 127*a* creates a seal between the valve cover 146 and the inlet port 101, while the second valve sealing element 127*b* creates a seal between the valve member 117 and the valve body 102. The first valve sealing element 127*a* and the second valve sealing element 127*b* further blocks leakage of the waste matter 113 at points of contact between the inlet port 101, the valve member 117, and the macerator cavity 119. The valve sealing elements 127*a* and 127*b* seal the valve gate 143 in the closed position. A first set of valve bolts 148 fasten the valve cover 146 to the valve body 102. A second set of valve bolts 149 fasten the valve member 117 within the valve body 102. In an embodiment, the valve seal components, for example, replaceable valve sealing elements 127*a* and 127*b*, etc., are replaceable.

Figures 6A, 6B:
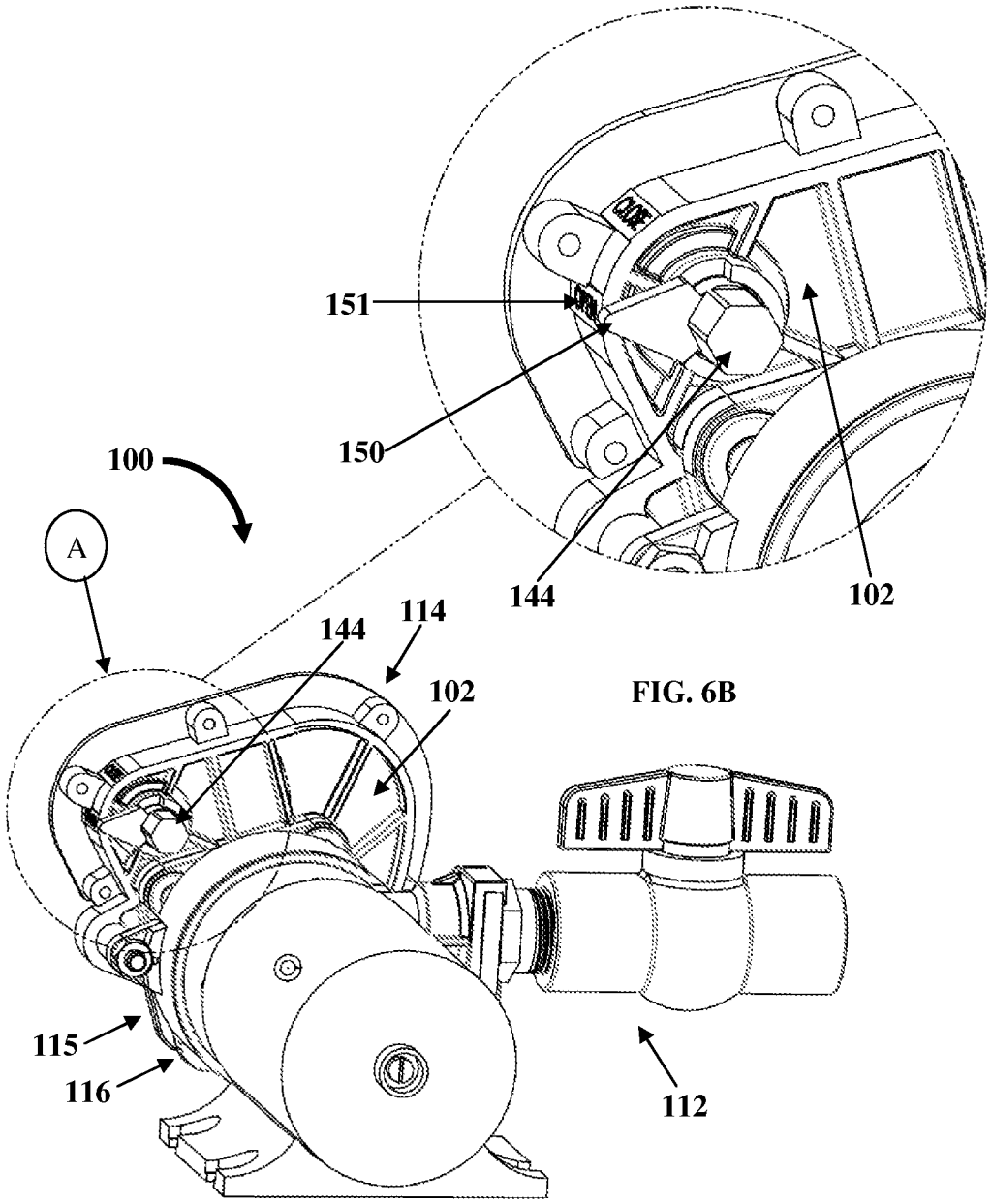
FIG. 6A exemplarily illustrates a rear perspective view of the macerator pump apparatus.
FIG. 6B exemplarily illustrates an enlarged view of a portion marked A in FIG. 6A, of the macerator pump apparatus.
Figures 6C, 6D:
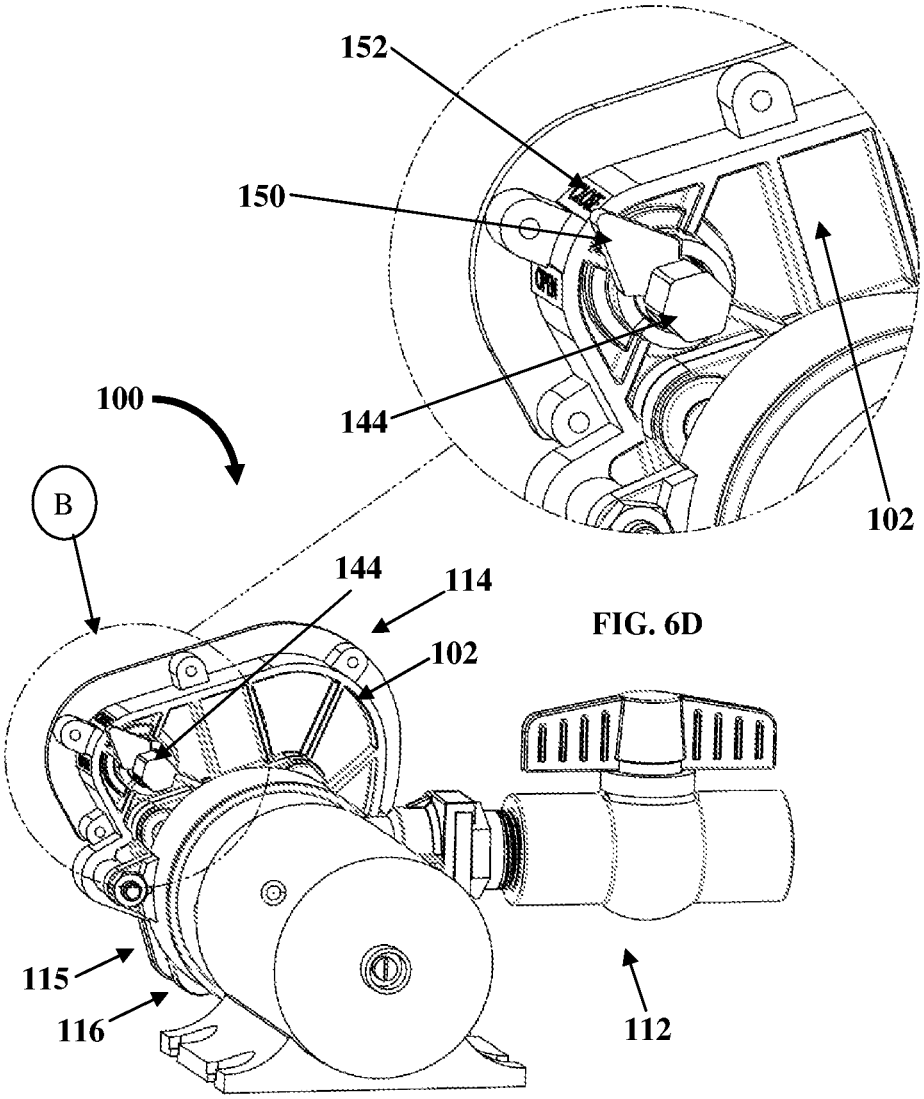
FIG. 6C exemplarily illustrates a rear perspective view of the macerator pump apparatus.
FIG. 6D exemplarily illustrates an enlarged view of a portion marked B in FIG. 6C, of the macerator pump apparatus.

FIG. 6A and FIG. 6C exemplarily illustrate rear perspective views of the macerator pump apparatus 100, showing a portion marked A and a portion marked B respectively. In an embodiment, the waste valve assembly 114 of the macerator pump apparatus 100 disclosed herein further comprises a quarter turn knob 144 operably connected to the valve member 117 exemplarily illustrated in FIG. 2, and the valve body 102 of the waste valve assembly 114. The quarter turn knob 144 induces an angular movement in the valve member 117 to open and close the valve member 117 within a one quarter turn range of the quarter turn knob 144. The operation of the valve member 117 is, for example, based on an angular movement instead of a sliding movement or a multi-turn movement. The quarter turn knob 144 opens and closes the valve member 117 by actuating a valve gate 143 operably connected to the valve member 117 as exemplarily illustrated in FIG. 5. In an embodiment, the waste valve assembly 114 further comprises an open and close indicator 150 operably connected to the quarter turn knob 144. The open and close indicator 150, in communication with the quarter turn knob 144, indicates an open position 151 and a closed position 152 of the valve member 117 as exemplarily illustrated in FIG. 6B and FIG. 6D respectively. FIG. 6B exemplarily illustrates an enlarged view of the portion marked A in FIG. 6A, showing an open position 151 of the valve member 117. FIG. 6D exemplarily illustrates an enlarged view of the portion marked B in FIG. 6C, showing a closed position 152 of the valve member 117.

Figure 7B:
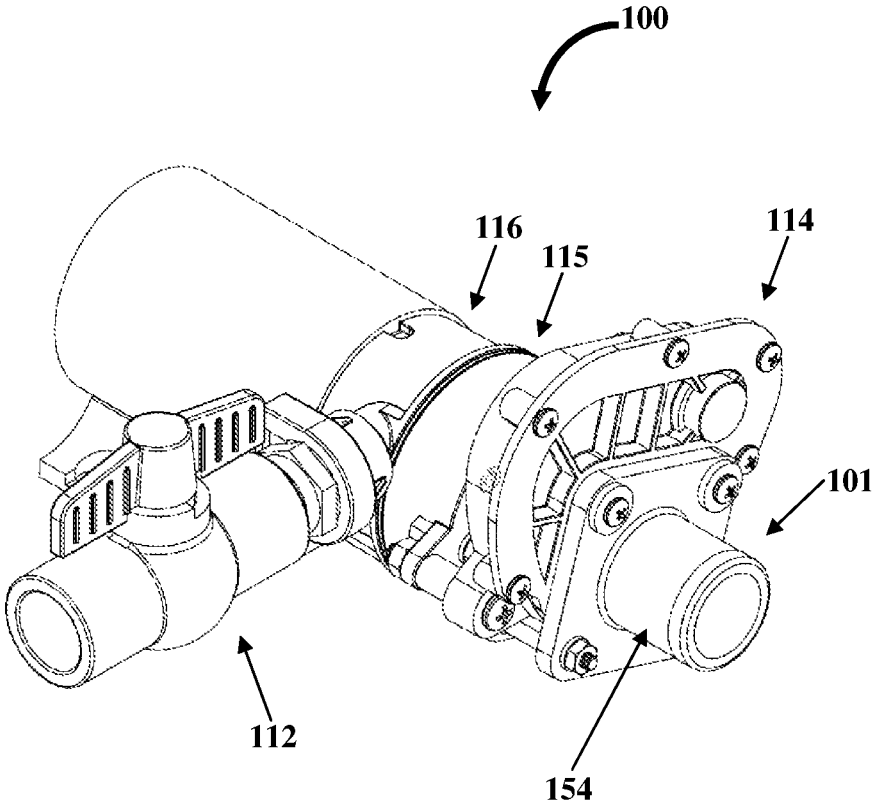
FIG. 7B exemplarily illustrates a front perspective view of the macerator pump apparatus, showing the inlet port of the waste valve assembly configured as a barb fit adaptor.
Figure 7C:
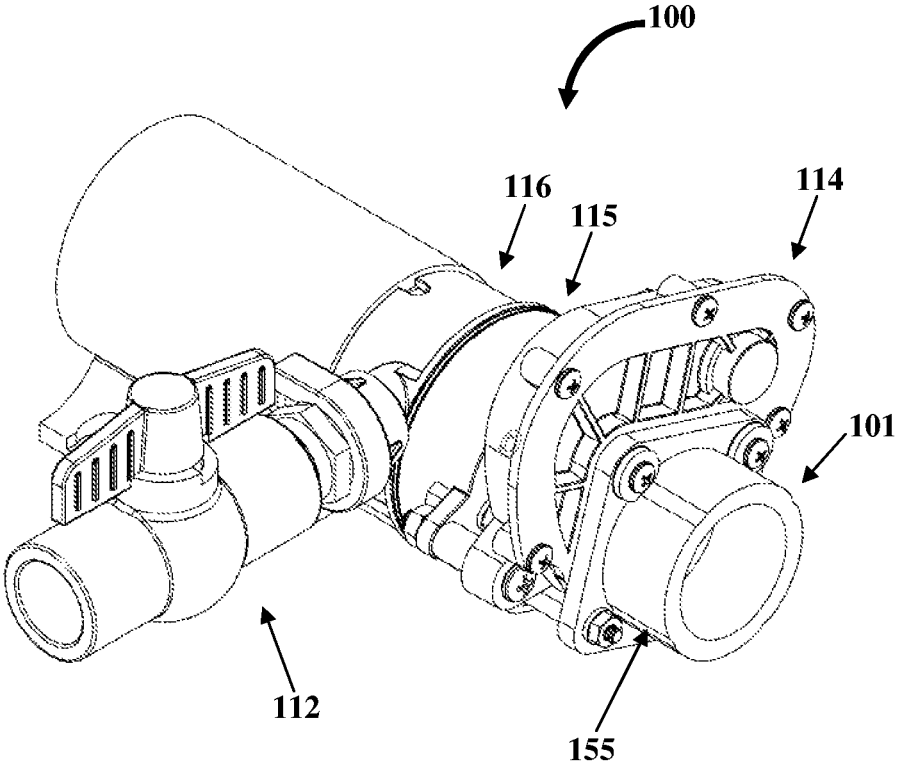
FIG. 7C exemplarily illustrates a front perspective view of the macerator pump apparatus, showing the inlet port of the waste valve assembly configured as a slip fit adaptor.

FIGS. 7A-7C exemplarily illustrate front perspective views of the macerator pump apparatus 100, shows different configurations of the inlet port 101 of the waste valve assembly 114. In an embodiment, the inlet port 101 of the waste valve assembly 114 is configured as a threaded fit adaptor 153 as exemplarily illustrated in FIG. 7A, a barb fit adaptor 154 as exemplarily illustrated in FIG. 7B, or a slip fit adaptor 155 as exemplarily illustrated in FIG. 7C to detachably connect to the tank outlet pipe 110 of the waste holding tank 111 exemplarily illustrated in FIGS. 1A-1B, in a threaded fit configuration, a barb fit configuration, or a slip fit configuration respectively. As used herein, the phrase "threaded fit" refers to a connection formed by connecting two parts, where an end of one part is threadably connected to an end of the other part via threaded sections defined on the ends. Also, as used herein, the phrase "barb fit" refers to a connection formed by connecting two parts, where an end of one part is axially pushed on to a protruding section defined on an end of the other part. Also, as used herein, the phrase "slip fit" refers to a connection formed by connecting two parts, where an end of one part is slipped over or glued to an end of the other part. The inlet port 101 is detachably connected to the tank outlet pipe 110 of the waste holding tank 111 to draw the waste matter 113 exemplarily illustrated in FIG. 1B, from the waste holding tank 111. If the inlet port 101 is configured as a threaded fit adaptor 153, the threaded fit adaptor 153 is threadably connected to the tank outlet pipe 110. If the inlet port 101 is configured as a barb fit adaptor 154, the tank outlet pipe 110 is axially pushed on to the barb fit adaptor 154 to form a press fit connection. As used herein, the phrase "press fit connection" refers to a connection formed between two parts, where an end of one part is pressed onto an end of the other part to form a tight fit. If the inlet port 101 is configured as a slip fit adaptor 155, the tank outlet pipe 110 is slipped over or glued to the slip fit adaptor 155 to form a slip fit connection.

Figure 8A:
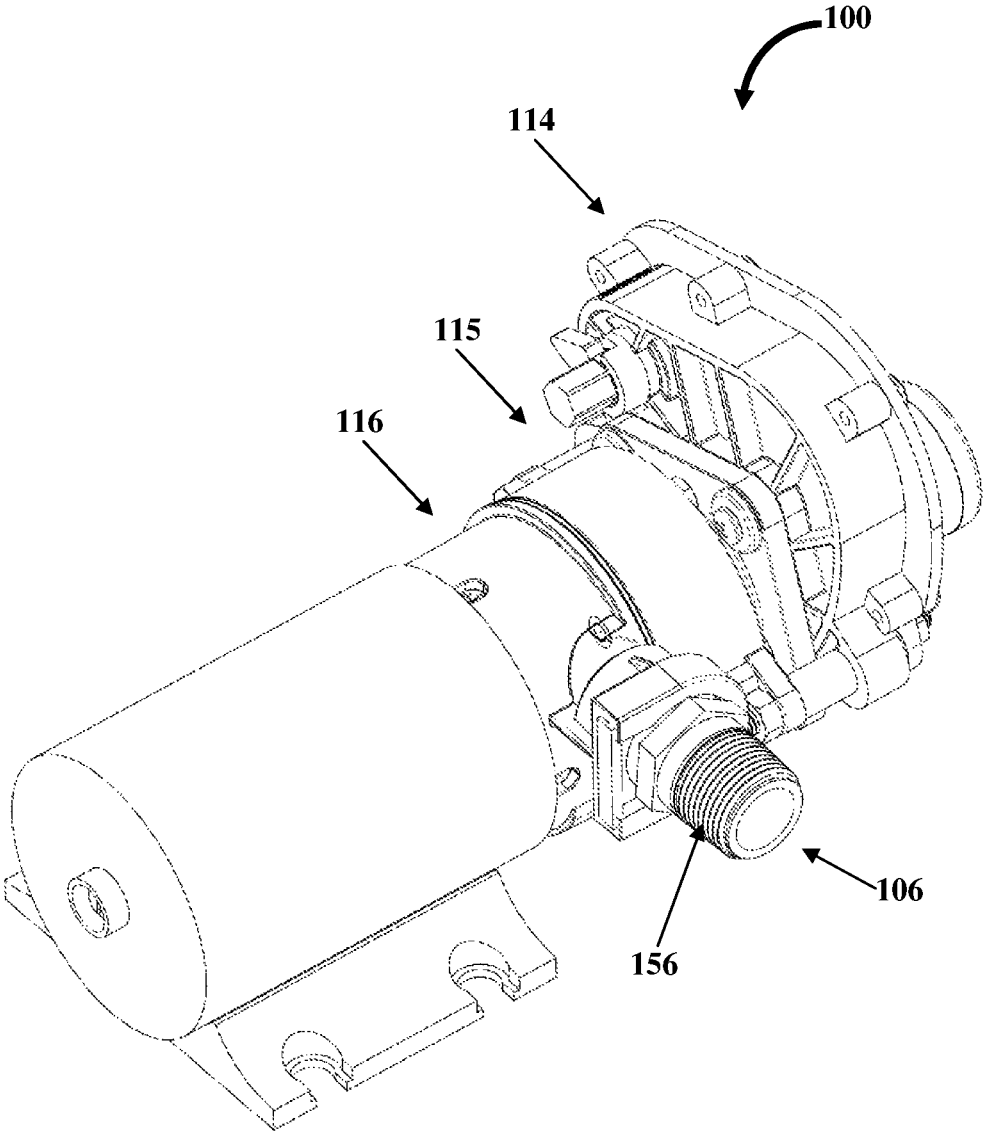
FIG. 8A exemplarily illustrates a rear perspective view of the macerator pump apparatus, showing a quick disconnect member of the quick disconnect discharge assembly configured as a threaded fit adaptor.
Figure 8B:
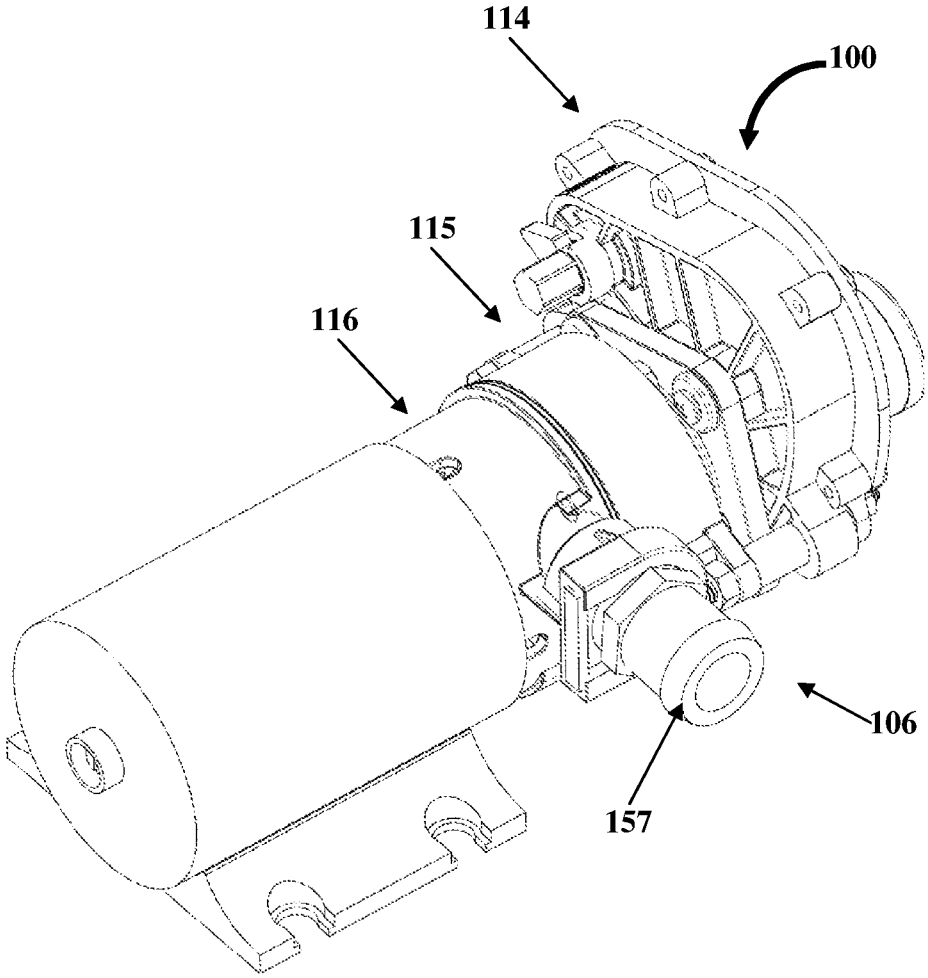
FIG. 8B exemplarily illustrates a rear perspective view of the macerator pump apparatus, showing the quick disconnect member of the quick disconnect discharge assembly configured as a barb fit adaptor.
Figure 8C:
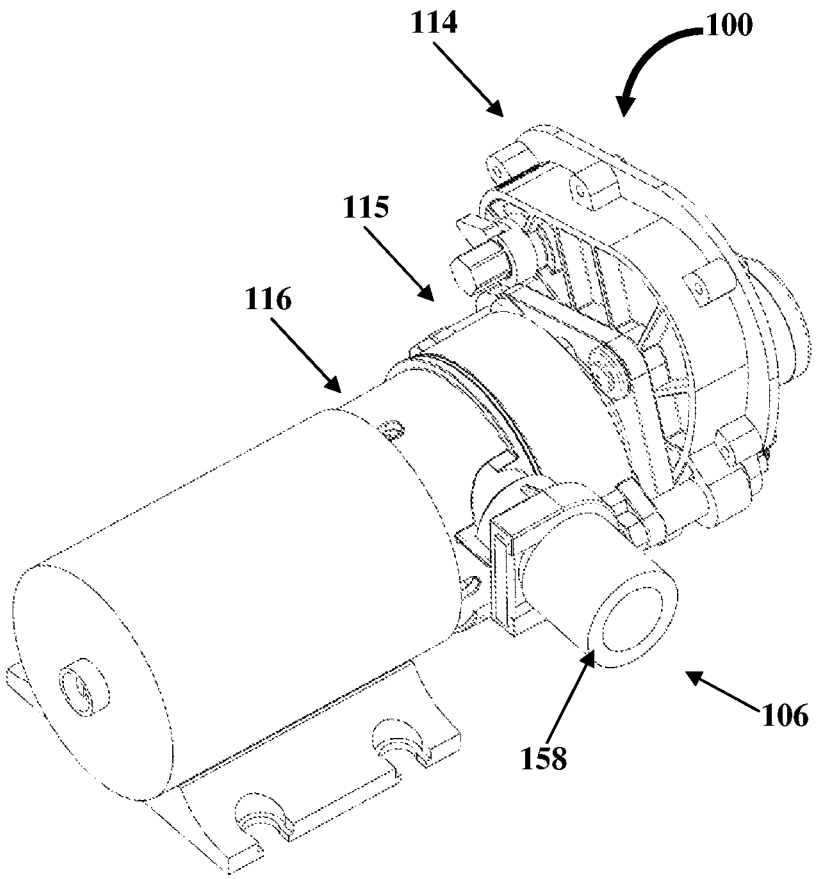
FIG. 8C exemplarily illustrates a rear perspective view of the macerator pump apparatus, showing the quick disconnect member of the quick disconnect discharge assembly configured as a slip fit adaptor.

FIGS. 8A-8C exemplarily illustrate rear perspective views of the macerator pump apparatus 100, showing different configurations of the quick disconnect member 106. In an embodiment, the quick disconnect member 106 is configured as a threaded fit adaptor 156 as exemplarily illustrated in FIG. 8A, as a barb fit adaptor 157 as exemplarily illustrated in FIG. 8B, or as a slip fit adaptor 158 as exemplarily illustrated in FIG. 8C, to detachably connect to the quick disconnect valve 107 exemplarily illustrated in FIGS. 3A-3B, or to the outlet plumbing pipe 108 exemplarily illustrated in FIGS. 1A-1B, in a threaded fit configuration, a barb fit configuration, or a slip fit configuration respectively. If the quick disconnect member 106 is configured as a threaded fit adaptor 156, the threaded fit adaptor 156 is threadably connected to the quick disconnect valve 107 or the outlet plumbing pipe 108. If the quick disconnect member 106 is configured as a barb fit adaptor 157, the quick disconnect valve 107 or the outlet plumbing pipe 108 is axially pushed on to the barb fit adaptor 157 to form a press fit connection. If the quick disconnect member 106 is configured as a slip fit adaptor 158, the quick disconnect valve 107 or the outlet plumbing pipe 108 is slipped over or glued to the slip fit adaptor 158 to form a slip fit connection.

Figure 9A:
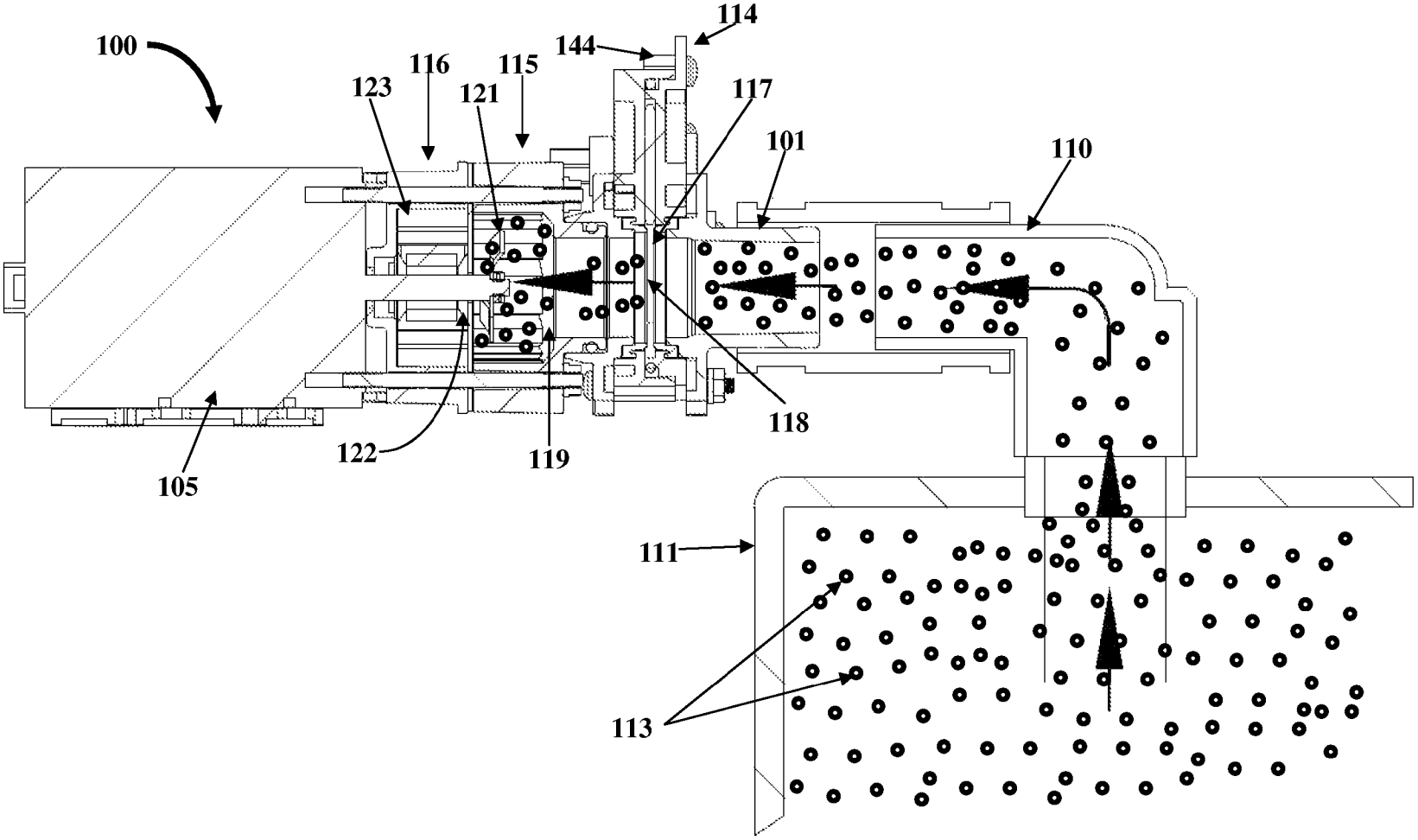
FIG. 9A exemplarily illustrates a partial sectional view of the macerator pump apparatus, showing the macerator pump apparatus removably connected to a waste holding tank to draw waste matter.
Figure 9B:
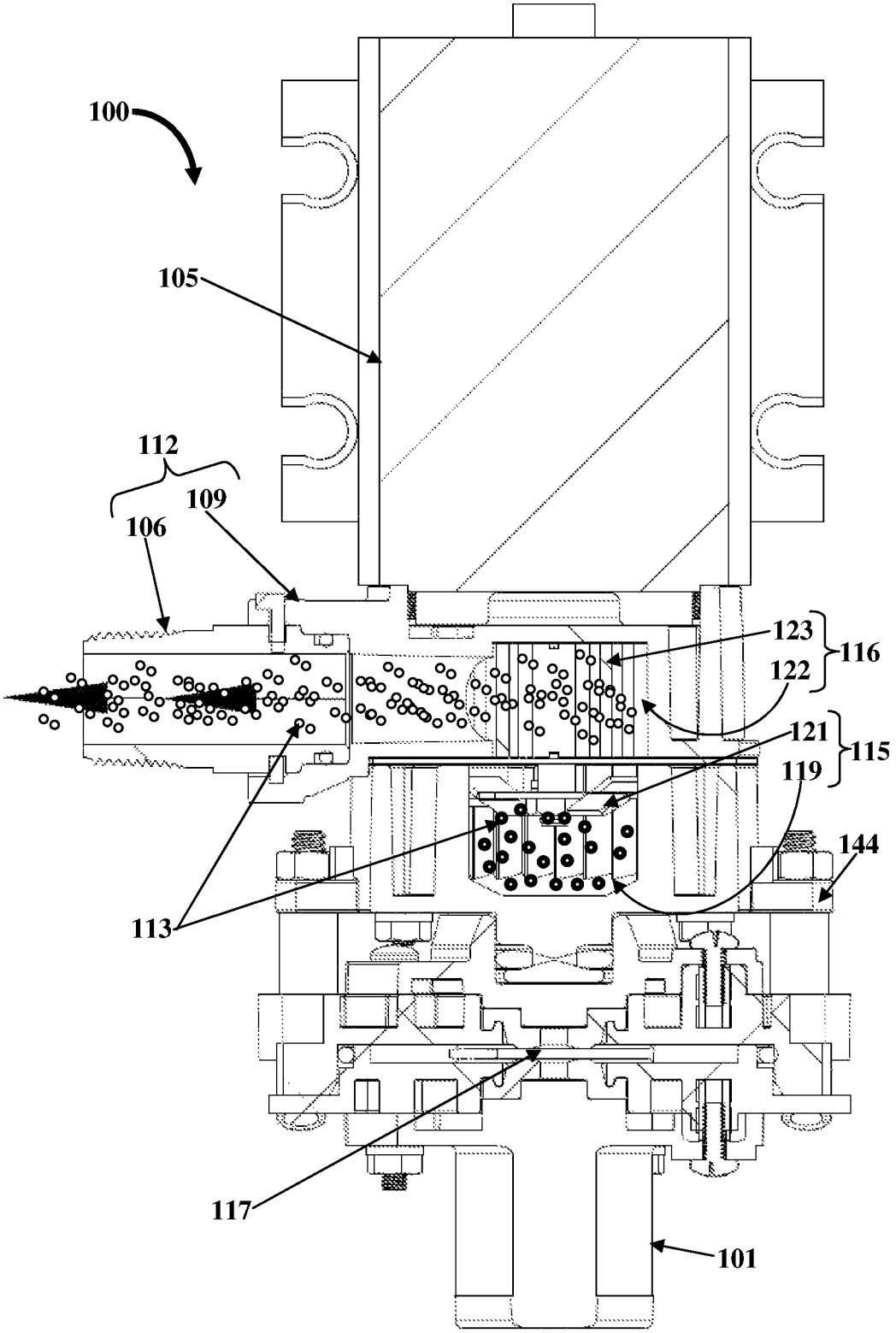
FIG. 9B exemplarily illustrates a partial sectional view of the macerator pump apparatus, showing the macerator pump apparatus discharging the macerated waste matter to the quick disconnect member of the quick disconnect discharge assembly via a discharge port.

FIGS. 9A-9B exemplarily illustrates partial sectional views of the macerator pump apparatus 100. FIG. 9A shows the macerator pump apparatus 100 removably connected to a waste holding tank 111 to draw waste matter 113. FIG. 9B shows the macerator pump apparatus 100 discharging the macerated waste matter 113 to the quick disconnect member 106 of the quick disconnect discharge assembly 112 via the discharge port 109. The macerator pump apparatus 100 is removably connected to the waste holding tank 111 by connecting the inlet port 101 to the tank outlet pipe 110. The valve member 117 is kept in an open position 151 using the quarter turn knob 144 as exemplarily illustrated in FIGS. 6A-6B. The electric motor 105 is actuated to drive the impeller 123 in the pump cavity 122 of the pumping assembly 116 to create a suction force. The suction force draws the waste matter 113 in the waste holding tank 111 through the inlet port 101 and the valve member 117 to the macerator cavity 119 of the macerator assembly 115 which is in fluid communication with the valve cavity 118 via the macerator adaptor 120 as exemplarily illustrated in FIG. 2 and as indicated by the arrows in FIG. 9A. The macerator blade 121 within the macerator cavity 119 macerates the waste matter 113. The impeller 123 within the pump cavity 122 of the pumping assembly 116 suctions the macerated waste matter 113 into the pump cavity 122. The impeller 123 pumps and discharges the macerated waste matter 113 from the pump cavity 122 to the quick disconnect member 106 via the discharge port 109 of the quick disconnect discharge assembly 112 as indicated by the arrows in FIG. 9B.

Figure 10:
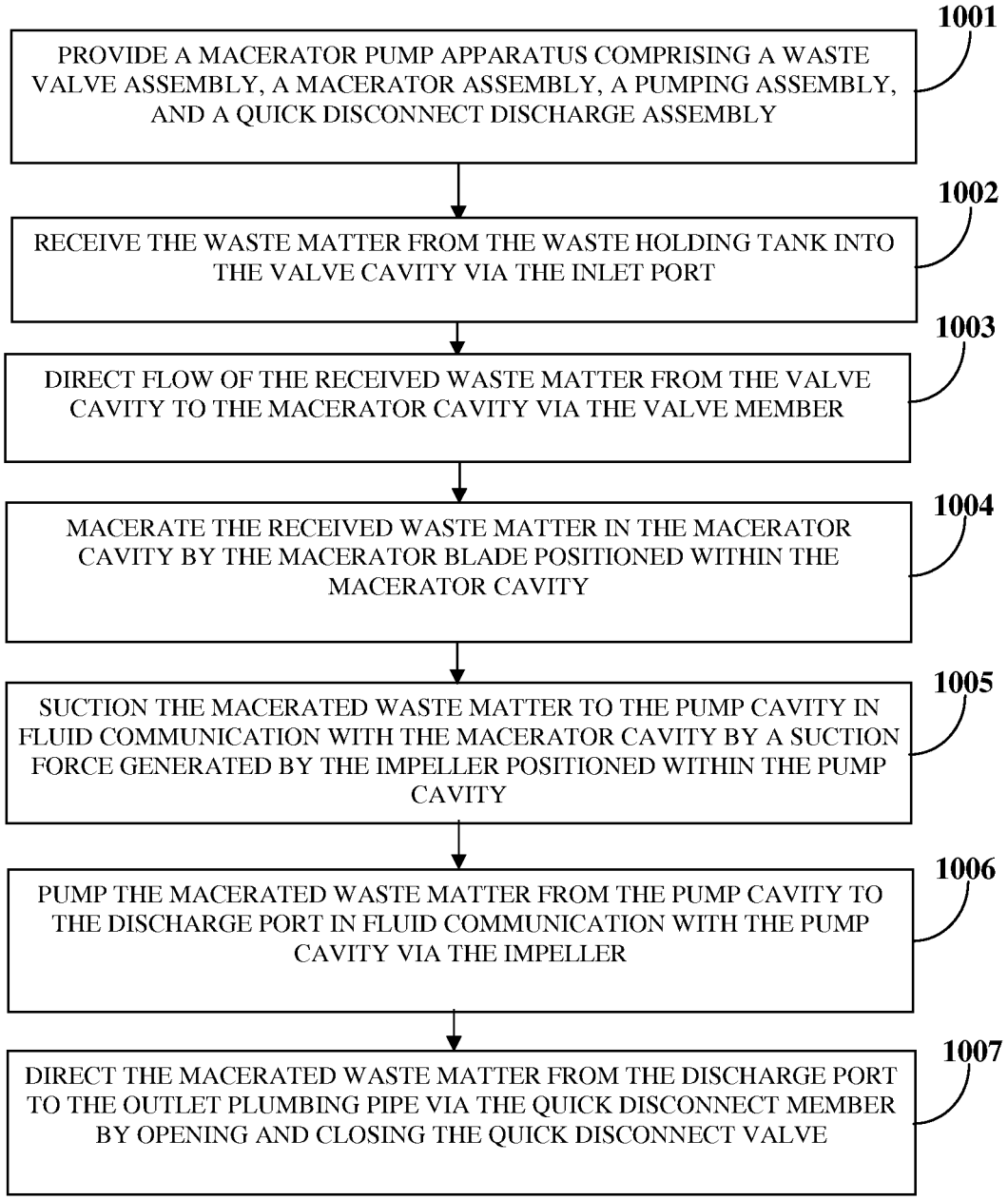
FIG. 10 illustrates a method for macerating and discharging waste matter.

FIG. 10 illustrates a method for macerating and discharging waste matter 113 exemplarily illustrated in FIG. 1B, FIG. 2, and FIGS. 9A-9B. The macerator pump apparatus 100 comprising the waste valve assembly 114, the macerator assembly 115, the pumping assembly 116, and the quick disconnect discharge assembly 112 as exemplarily illustrated in FIGS. 1A-8C and as disclosed in the detailed description of FIGS. 1A-8C is provided 1001. The inlet port 101 of the waste valve assembly 114 detachably connected to the waste holding tank 111 receives 1002 the waste matter 113 from the waste holding tank 111 into the valve cavity 118 of the valve body 102 of the waste valve assembly 114. The valve member 117 of the waste valve assembly 114 directs 1003 the flow of the received waste matter 113 from the valve cavity 118 to the macerator cavity 119 of the macerator assembly 115. The macerator blade 121 positioned within the macerator cavity 119 of the macerator assembly 115 macerates 1004 the received waste matter 113 in the macerator cavity 119 of the macerator assembly 115. The electric motor 105 rotates the macerator blade 121 via the shaft 124 of the electric motor 105 for macerating the received waste matter 113. A suction force generated by the impeller 123 positioned within the pump cavity 122 suctions 1005 the macerated waste matter 113 to the pump cavity 122 of the pumping assembly 116 which is in fluid communication with the macerator cavity 119. The electric motor 105 rotates the impeller 123 via the shaft 124 of the electric motor 105 for generating the suction force. The impeller 123 pumps 1006 the macerated waste matter 113 from the pump cavity 122 to the discharge port 109 of the quick disconnect discharge assembly 112 in fluid communication with the pump cavity 122. The quick disconnect member 106 of the quick disconnect discharge assembly 112 directs 1007 the macerated waste matter 113 from the discharge port 109 to the outlet plumbing pipe 108 by opening and closing the quick disconnect valve 107 of the quick disconnect discharge assembly 112.

Figure 11:
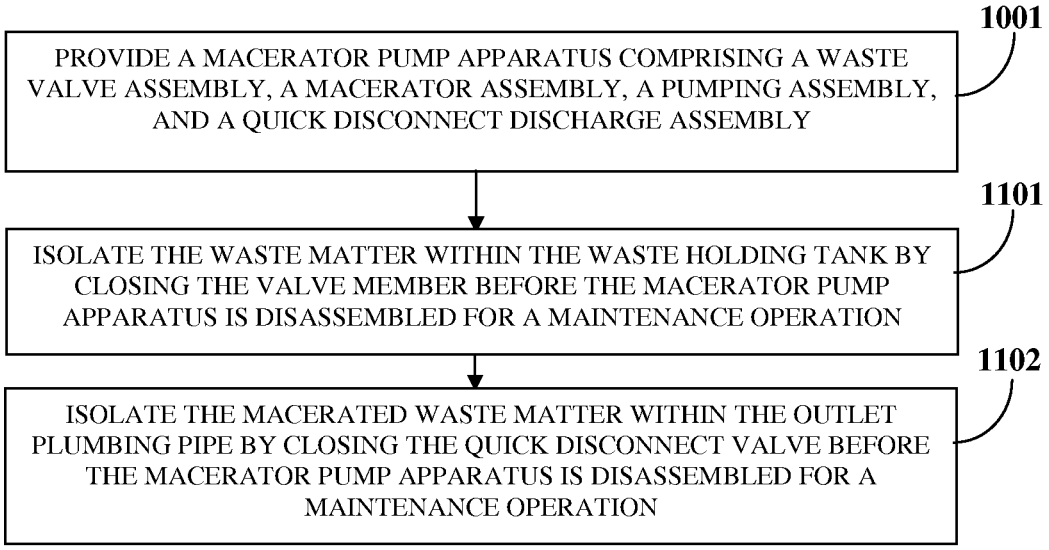
FIG. 11 illustrates a method for isolating waste matter within a waste holding tank and isolating the macerated waste matter within an outlet plumbing pipe during a maintenance operation of the macerator pump apparatus.

FIG. 11 illustrates a method for isolating waste matter 113 within a waste holding tank 111 and isolating the macerated waste matter 113 within an outlet plumbing pipe 108 exemplarily illustrated in FIG. 1B, FIG. 2, and FIGS. 9A-9B, during a maintenance operation of the macerator pump apparatus 100. The macerator pump apparatus 100 comprising the waste valve assembly 114, the macerator assembly 115, the pumping assembly 116, and the quick disconnect discharge assembly 112 as exemplarily illustrated in FIGS. 1A-8C and as disclosed in the detailed description of FIGS. 1A-8C is provided 1001. The closing of the valve member 117 of the waste valve assembly 114 isolates 1101 the waste matter 113 within the waste holding tank 111 before the macerator pump apparatus 100 is disassembled for a maintenance operation as disclosed in the detailed description of FIG. 2. The valve member 117 isolates the waste matter 113 from the waste holding tank 111. The closing of the quick disconnect valve 107 of the quick disconnect discharge assembly 112 isolates 1102 the macerated waste matter 113 within the outlet plumbing pipe 108 before the macerator pump apparatus 100 is disassembled for a maintenance operation as disclosed in the detailed description of FIGS. 3A-3B. The quick disconnect valve 107 isolates the waste matter 113 from the outlet plumbing pipe 108 or discharge lines.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A macerator pump apparatus, comprising:

a waste valve assembly, comprising:

an inlet port detachably connected to a waste holding tank, said inlet port configured to receive waste matter from said waste holding tank;

a valve body defining a valve cavity, said valve cavity in fluid communication with said inlet port; and a valve member positioned within said valve cavity of said valve body, said valve member configured to direct flow of said waste matter from said valve cavity to a macerator cavity of a macerator assembly in fluid communication with said valve cavity via a macerator adaptor, said valve member further configured to isolate said waste matter within said waste holding tank by closing said valve member before said macerator pump apparatus is disassembled for a maintenance operation;

said macerator assembly removably fastened to said waste valve assembly, said macerator assembly comprising a macerator housing defining said macerator cavity configured to receive said waste matter from said valve cavity of said waste valve assembly, said macerator assembly configured to macerate said waste matter in said macerator cavity and transfer said macerated waste matter to a pump cavity of a pumping assembly in fluid communication with said macerator cavity;

said pumping assembly fixedly connected to said macerator assembly, said pumping assembly comprising a pump housing defining said pump cavity configured to receive said macerated waste matter from said macerator cavity of said macerator assembly, said pumping assembly configured to pump said macerated waste matter to a discharge port of a quick disconnect discharge assembly in fluid communication with said pump cavity; and said quick disconnect discharge assembly operably connected to said pumping assembly, said quick disconnect discharge assembly comprising:

said discharge port extending from said pump housing of said pumping assembly, said discharge port configured to receive said macerated waste matter from said pump cavity of said pumping assembly;

a quick disconnect member operably connected to said discharge port, said quick disconnect member configured to detachably connect an outlet plumbing pipe to said discharge port via a quick disconnect valve for discharging said macerated waste matter; and said quick disconnect valve configured to detachably connect said quick disconnect member to said outlet plumbing pipe, said quick disconnect valve further configured to open and close said outlet plumbing pipe to direct flow of said macerated waste matter through said outlet plumbing pipe, said quick disconnect valve further configured to isolate said macerated waste matter within said outlet plumbing pipe by closing said quick disconnect valve before said macerator pump apparatus is disassembled for said maintenance operation.

2. The macerator pump apparatus of claim 1, wherein said macerator assembly further comprises a macerator blade positioned within said macerator cavity of said macerator assembly, wherein said macerator blade is rotated by an electric motor via a shaft of said electric motor, wherein said shaft of said electric motor is fixedly connected to a hub of said macerator blade, and wherein said macerator blade is configured to macerate said waste matter and direct said macerated waste matter to said pump cavity of said pumping assembly in fluid communication with said macerator cavity.

3. The macerator pump apparatus of claim 1, wherein said pumping assembly further comprises an impeller positioned within said pump cavity of said pumping assembly, wherein said impeller is connected to and rotated by an electric motor via a shaft of said electric motor, wherein said shaft of said electric motor is fixedly connected to said impeller, wherein said impeller is configured to pump said macerated waste matter to said discharge port of said quick disconnect discharge assembly in fluid communication with said pump cavity.

4. The macerator pump apparatus of claim 3, wherein said impeller of said pumping assembly is made of an elastomeric material.

5. The macerator pump apparatus of claim 1, wherein said quick disconnect discharge assembly further comprises a discharge seal member positioned between said quick disconnect member and said discharge port of said quick disconnect discharge assembly, wherein said discharge seal member is configured to provide a seal between said quick disconnect member and said discharge port to prevent leakage of said macerated waste matter.

6. The macerator pump apparatus of claim 5, wherein said discharge seal member is an O-ring type seal.

7. The macerator pump apparatus of claim 1, wherein said waste valve assembly further comprises a quarter turn knob operably connected to said valve member and said valve body of said waste valve assembly, wherein said quarter turn knob is configured to induce an angular movement in said valve member to open and close said valve member within a one quarter turn range of said quarter turn knob.

8. The macerator pump apparatus of claim 7, wherein said waste valve assembly further comprises an open and close indicator operably connected to said quarter turn knob, wherein said open and close indicator, in communication with said quarter turn knob, is configured to indicate an open position and a closed position of said valve member.

9. The macerator pump apparatus of claim 1, wherein said valve member of said waste valve assembly is a sliding gate valve.

10. The macerator pump apparatus of claim 1, wherein said inlet port of said waste valve assembly is configured as one of a threaded fit adaptor, a barb fit adaptor, and a slip fit adaptor to detachably connect to said waste holding tank in one of a threaded fit configuration, a barb fit configuration, and a slip fit configuration respectively.

11. The macerator pump apparatus of claim 1, wherein said quick disconnect member of said quick disconnect discharge assembly is configured as one of a threaded fit adaptor, a barb fit adaptor, and a slip fit adaptor to detachably connect to one of said quick disconnect valve and said outlet plumbing pipe in one of a threaded fit configuration, a barb fit configuration, and a slip fit configuration respectively.

12. The macerator pump apparatus of claim 1, wherein said waste valve assembly is made of an inert material.

13. The macerator pump apparatus of claim 1, wherein said waste valve assembly further comprises a first valve sealing element sandwiched between said inlet port and said valve member of said waste valve assembly, and a second valve sealing element sandwiched between said valve member of said waste valve assembly and said macerator housing of said macerator assembly, wherein said first valve sealing element and said second valve sealing element are configured to block leakage of said waste matter at points of contact between said inlet port, said valve member, and said macerator cavity.

14. The macerator pump apparatus of claim 1, further comprising a clip member operably inserted between said discharge port and said quick disconnect member of said quick disconnect discharge assembly, wherein said clip member is configured to detachably connect said quick disconnect member to said discharge port.

15. The macerator pump apparatus of claim 1, wherein said waste valve assembly is removably fastened directly to a combination of said macerator assembly, said pumping assembly, and said quick disconnect discharge assembly with minimal space requirements.

16. The macerator pump apparatus of claim 1, wherein said waste valve assembly is one of operated manually and operated using a tool member within a quarter turn of said tool member.

17. The macerator pump apparatus of claim 1, wherein said waste valve assembly further comprises replaceable valve seal components.

18. The macerator pump apparatus of claim 1, wherein said waste valve assembly is configured to fit in a limited space.

19. A method for macerating and discharging waste matter, said method comprising:

providing a macerator pump apparatus comprising:

a waste valve assembly, comprising:

an inlet port detachably connected to a waste holding tank;

a valve body defining a valve cavity, said valve cavity in fluid communication with said inlet port; and a valve member positioned within said valve cavity of said valve body;

a macerator assembly removably fastened to said waste valve assembly, said macerator assembly comprising a macerator housing defining a macerator cavity, and a macerator blade, wherein said macerator cavity is in fluid communication with said valve cavity of said waste valve assembly via a macerator adaptor;

a pumping assembly fixedly connected to said macerator assembly, said pumping assembly comprising a pump housing defining a pump cavity, and an impeller; and a quick disconnect discharge assembly operably connected to said pumping assembly, said quick disconnect discharge assembly comprising:

a discharge port extending from said pump housing of said pumping assembly;

a quick disconnect member operably connected to said discharge port, said quick disconnect member configured to detachably connect an outlet plumbing pipe to said discharge port via a quick disconnect valve; and said quick disconnect valve configured to detachably connect said quick disconnect member to said outlet plumbing pipe;

receiving said waste matter from said waste holding tank into said valve cavity of said valve body of said waste valve assembly by said inlet port;

directing flow of said received waste matter from said valve cavity to said macerator cavity of said macerator assembly by said valve member of said waste valve assembly;

macerating said received waste matter in said macerator cavity of said macerator assembly by said macerator blade positioned within said macerator cavity of said macerator assembly;

suctioning said macerated waste matter to said pump cavity of said pumping assembly in fluid communication with said macerator cavity by a suction force generated by said impeller positioned within said pump cavity;

pumping said macerated waste matter from said pump cavity to said discharge port of said quick disconnect discharge assembly in fluid communication with said pump cavity by said impeller; and directing said macerated waste matter from said discharge port to said outlet plumbing pipe via said quick disconnect member of said quick disconnect discharge assembly by opening and closing said quick disconnect valve of said quick disconnect discharge assembly.

20. The method of claim 19, further comprising rotating said macerator blade of said macerator assembly by an electric motor via a shaft of said electric motor to macerate said received waste matter and direct said macerated waste matter to said pump cavity of said pumping assembly in fluid communication with said macerator cavity, wherein said shaft of said electric motor is fixedly connected to a hub of said macerator blade.

21. The method of claim 19, further comprising rotating said impeller of said pumping assembly by an electric motor via a shaft of said electric motor to pump said macerated waste matter to said discharge port of said quick disconnect discharge assembly in fluid communication with said pump cavity of said pumping assembly, wherein said shaft of said electric motor is fixedly connected to said impeller.

22. The method of claim 19, further comprising inducing an angular movement in said valve member of said waste valve assembly to open and close said valve member by a quarter turn knob operably connected to said valve member and said valve body of said waste valve assembly, wherein said quarter turn knob is configured to open and close said valve member within a one quarter turn range of said quarter turn knob.

23. The method of claim 19, further comprising detachably connecting said quick disconnect member of said quick disconnect discharge assembly to said discharge port of said quick disconnect discharge assembly by a clip member operably inserted between said discharge port and said quick disconnect member.

24. A method for isolating waste matter within a waste holding tank, and isolating macerated waste matter within an outlet plumbing pipe during a maintenance operation of a macerator pump apparatus, said method comprising:

providing said macerator pump apparatus comprising:

a waste valve assembly, comprising:

an inlet port detachably connected to said waste holding tank, said inlet port configured to receive said waste matter from said waste holding tank;

a valve body defining a valve cavity, said valve cavity in fluid communication with said inlet port; and a valve member positioned within said valve cavity of said valve body, said valve member configured to direct flow of said waste matter from said valve cavity to a macerator cavity of a macerator assembly in fluid communication with said valve cavity via a macerator adaptor;

said macerator assembly removably fastened to said waste valve assembly, said macerator assembly comprising a macerator housing defining said macerator cavity configured to receive said waste matter from said valve cavity of said waste valve assembly, said macerator assembly configured to macerate said waste matter in said macerator cavity and transfer said macerated waste matter to a pump cavity of a pumping assembly in fluid communication with said macerator cavity;

said pumping assembly fixedly connected to said macerator assembly, said pumping assembly comprising a pump housing defining said pump cavity configured to receive said macerated waste matter from said macerator cavity of said macerator assembly, said pumping assembly configured to pump said macerated waste matter to a discharge port of a quick disconnect discharge assembly in fluid communication with said pump cavity; and said quick disconnect discharge assembly operably connected to said pumping assembly, said quick disconnect discharge assembly comprising:

said discharge port extending from said pump housing of said pumping assembly, said discharge port configured to receive said macerated waste matter from said pump cavity of said pumping assembly;

a quick disconnect member operably connected to said discharge port, said quick disconnect member configured to detachably connect said outlet plumbing pipe to said discharge port via a quick disconnect valve for discharging said macerated waste matter; and said quick disconnect valve configured to detachably connect said quick disconnect member to said outlet plumbing pipe, said quick disconnect valve further configured to open and close said outlet plumbing pipe to direct flow of said macerated waste matter through said outlet plumbing pipe;

isolating said waste matter within said waste holding tank by closing said valve member of said waste valve assembly before said macerator pump apparatus is disassembled for said maintenance operation; and isolating said macerated waste matter within said outlet plumbing pipe by closing said quick disconnect valve of said quick disconnect discharge assembly before said macerator pump apparatus is disassembled for said maintenance operation.

* * * * *